US005707219A

United States Patent [19]

Powers

[11] Patent Number: 5,707,219

[45] Date of Patent: Jan. 13, 1998

[54] DIAPHRAGM PUMP

[75] Inventor: Frederick Allan Powers, Maple Grove, Minn.

[73] Assignee: Wanner Engineering, Minneapolis, Minn.

[21] Appl. No.: 539,179

[22] Filed: Oct. 4, 1995

[51] Int. Cl.[6] ..... F04B 35/02

[52] U.S. Cl. ..... 417/386; 92/100; 417/387; 417/388; 417/269

[58] Field of Search ..... 417/386, 387, 417/388; 92/100

[56] References Cited

U.S. PATENT DOCUMENTS

| | | | |
|---|---|---|---|
| 1,198,971 | 9/1916 | Taylor | 92/100 |
| 1,769,044 | 7/1930 | Stevens | 417/388 |
| 3,775,030 | 11/1973 | Wanner | 417/388 |
| 3,884,598 | 5/1975 | Wanner | 417/386 |
| 4,392,787 | 7/1983 | Notta | 417/388 X |
| 4,776,774 | 10/1988 | Anastasia | 417/388 X |

FOREIGN PATENT DOCUMENTS

| | | |
|---|---|---|
| 0 148 691 | 12/1984 | European Pat. Off. . |
| 84 37 633 U | 12/1984 | Germany . |
| 4420 863 A1 | 12/1995 | Germany . |
| 195 31 064 A1 | 2/1996 | Germany . |

*Primary Examiner*—Richard E. Gluck

*Attorney, Agent, or Firm*—Merchant, Gould, Smith, Edell, Welter & Schmidt, P.A.

[57] ABSTRACT

A diaphragm pump is provided having a plurality of piston inlets connecting a hydraulic fluid source with the piston chamber and a plurality of check valves each having a ball and valve seat disposed within the inlets. The valve seat includes a conical section sloped such that the tangential contact point between the ball and valve seat is located at a position outward from the inner edge of the valve seat. The distance the ball is permitted to move between the open and closed positions is such that the check valve closes substantially in conjunction with the piston beginning its power stroke and the ball is not able to generate a high closure velocity. A diaphragm plunger includes a spherical surface portion designed to impact a diaphragm stop at a position away from the edges of the stop and plunger. An isolation reservoir is connected to a piston reciprocating chamber such that hydraulic fluid completely fills the piston reciprocating chamber and further flows into the isolation reservoir. A sliding valve includes a housing which has at least one elongated slot to permit the flow of hydraulic fluid into the piston chamber.

12 Claims, 22 Drawing Sheets

DIAPHRAGM PUMP

BACKGROUND OF THE INVENTION

1. Field of the Invention

The present invention relates generally to an improved diaphragm pump and more specifically to an improved diaphragm pump for use under pressure feed conditions.

2. Description of the Art

Diaphragm pumps which presently exist in the prior art include a diaphragm, a pumping chamber on one side of the diaphragm containing an inlet passage and discharge passage, a piston chamber filled with hydraulic fluid and separated from the pumping chamber by the diaphragm and a piston assembly defining one end of the piston chamber and adapted for reciprocating movement between a first position and a second position to define a power stroke and return stroke. Such a pump is disclosed in U.S. Pat. No. 3,884,598. During operation, the piston moves toward (power stroke) and away (return stroke) from the diaphragm, or into and out of the piston chamber thereby causing such reciprocating movement to be transferred, by the hydraulic fluid which fills the piston chamber, to the diaphragm. As the piston moves away from the diaphragm, the diaphragm flexes away from the pumping chamber, allowing the pumping fluid to be drawn into the pumping chamber through the inlet passage. As the piston moves toward the diaphragm, the diaphragm flexes toward the pumping chamber, causing the fluid in the pumping chamber to be discharged through the discharge passage.

Prior diaphragm pumps include some type of mechanism to cause the reciprocation of the piston. It is known to utilize a cam or wobble plate which is canted with respect to its center shaft so that the rotation of the center shaft causes reciprocation of the wobble plate which transfers such motion to the piston. The wobble plate mechanism is typically located adjacent the piston assembly in an enclosed compartment filled with hydraulic fluid. In this way, the hydraulic fluid lubricates the wobble plate mechanism while also serving as a hydraulic fluid source for the piston assembly.

The prior diaphragm pumps also include an inlet from the hydraulic fluid source into the piston chamber. Typically, some type of reload check valve is disposed within the inlet to permit the flow of hydraulic fluid into the piston chamber when the pressure in the piston chamber is less than the pressure in the hydraulic fluid source and to prevent the flow of hydraulic fluid into the piston chamber when the pressure in the piston chamber is greater than the pressure in the hydraulic fluid source. In this way, the reload check valve is closed during the power stroke and is open during at least a portion of the return stroke to allow replenishing of any hydraulic fluid in the piston chamber lost between the piston and piston housing during the power stroke.

Typically, a sliding valve is also utilized in these prior diaphragm pumps to regulate the flow of hydraulic fluid from the hydraulic fluid source into the piston chamber based on the relative positions of the piston and diaphragm. The sliding valve includes a cylinder connected to the diaphragm which is disposed in a corresponding cylinder housing of the piston where it is biased toward the cylinder housing. The piston cylinder housing includes a circular port or hole positioned between the hydraulic fluid inlet and the cylinder. Based on the relative movement between the piston and diaphragm due to the varying amount of hydraulic fluid in the piston chamber, the sliding valve is variable between an open position in which the cylinder housing port is open to allow hydraulic fluid into the piston chamber and a closed position in which the cylinder connected to the diaphragm blocks the port to prevent the flow of hydraulic fluid into the piston chamber.

The piston assembly in these prior diaphragm pumps includes a diaphragm stop disposed adjacent the diaphragm within the piston chamber. The diaphragm stop is positioned to limit the return movement of the diaphragm toward the piston which allows the piston chamber to be replenished with hydraulic fluid lost during the power stroke when the pump is operating under pressure feed conditions. The diaphragm includes a diaphragm plunger connected to the diaphragm such that the diaphragm plunger contacts the diaphragm stop when the pump is operating under pressure feed conditions. In this way, during the return stroke under pressure feed, the diaphragm plunger contacts the diaphragm stop to stop the movement of the diaphragm toward the piston while the piston continues to move an additional distance to complete the return stroke. This allows the pressure in the piston chamber to drop below the pressure in the pumping chamber as well below the pressure in the hydraulic fluid source. At this point, the reload check valve opens to allow replenishing of hydraulic fluid in the piston chamber, if necessary, before the piston begins its power stroke. It should be noted that the position of the piston upon completing the return stroke is referred to as bottom dead center.

These prior diaphragm pumps described above were originally designed for vacuum feed conditions where the pumping fluid is not under pressure. In operation, these prior diaphragm pumps performed sufficiently under vacuum feed conditions. These prior pumps were also utilized for pressure feed applications where the pumping fluid is supplied under pressure. In actual operation under pressure feed conditions, however, these prior diaphragm pumps experience numerous problems. These problems have led to drastically reduced pump life and performance under pressure feed conditions to the point where these prior diaphragm pumps have experienced pump failure after only approximately 5% of the expected life of the pump under normal (vacuum feed) conditions.

First, as described above, the diaphragm impacts the diaphragm stop during each return stroke under pressure feed conditions. The diaphragm plunger in these prior diaphragm pumps was designed so that the linear impact surface of the plunger was parallel with the linear impact surface of the diaphragm stop. This allowed the force of the impact to be evenly distributed along the entire impact surface of the plunger and diaphragm stop. However, during actual operation, the plunger often impacts the diaphragm stop at varying angles other than precisely parallel to the diaphragm stop due to the flexible nature of the diaphragm. Additionally, manufacturing tolerances preclude having parts match perfectly. As a practical matter, it is not feasible to manufacture the impact surfaces of the plunger and diaphragm stop so close to parallel to assure uniform contact along the entire length of these surfaces. Rather, the manufacture of these surfaces will vary so that the slope of the plunger impact surface is often steeper or shallower than the corresponding slope of the diaphragm stop.

The result of the plunger impacting the diaphragm stop off center or the impact surfaces of the plunger or diaphragm stop being manufactured off parallel is that the plunger impacts the diaphragm stop at varying positions other than parallel. In particular, the plunger and diaphragm stop impact, and thus concentrate the impact forces, at the extreme limits of possible contact, the inner edge of the diaphragm stop and the outer edge of the plunger. Over time, repeated contacts between the plunger and diaphragm stop concentrated at these extreme edges can lend to chipping of the inner edge of the diaphragm stop or the outer edge of the plunger.

Since the piston chamber is entirely enclosed, these chips from the inner edge of the diaphragm stop or the outer edge of the plunger have no means of escaping from the piston chamber and thus move around within the piston chamber, contacting the various components of the piston assembly, such as the piston and piston housing. This results in significant deterioration of the piston assembly reducing the useful life of the pump. This can even lead to complete pump failure if these chips become lodged between the piston and the piston housing to lock up the piston all together. It should be noted that this problem with chipping of the diaphragm stop and plunger is not present under vacuum feed conditions since the diaphragm plunger does not normally contact the diaphragm stop during the return stroke as shown in FIG. 3.

Another problem with these prior diaphragm pumps under pressure feed conditions concerns the build up of excessive pressure within the piston chamber during the power stroke. The graph shown in FIG. 19 illustrates the build up of pressure (line A) in the piston chamber in relation to the movement of the piston during the power stroke under pressure feed conditions for a prior diaphragm pump. The velocity of the piston during the power stroke is also shown on the graph (line B). For the particular pump shown in the graph, the expected pressure is approximately 1,000 psi during the power stroke. As the graph illustrates (line A), the actual pressures experienced within the piston chamber include pressure peaks up to approximately 3,000 psi, or three times the expected pressure. During pump operation under pressure feed, these extreme pressure oscillations tend to cause significant deterioration of the piston assembly components at a much faster rate than under vacuum feed conditions.

There are several explanations concerning the cause of this excessive pressure build up in the piston chamber under pressure feed conditions. First, the closure time for the reload check valve noticeably effects the pressure build up during the start of the power stroke. As explained above, the piston chamber is only able to replenish its hydraulic fluid under pressure feed conditions after the diaphragm plunger impacts the diaphragm stop and the piston moves the additional limited distance to complete the return stroke. This allows the piston chamber to depressurize to a level below that in the hydraulic fluid source (which is at atmospheric pressure). During this limited time period, the reload check valve, which had been closed during the power stroke and most of the return stroke, is now opened with the hydraulic fluid from the hydraulic fluid source driving the ball to its open position. The hydraulic fluid flows around the ball and down the hydraulic fluid inlet and into the piston chamber to replenish any hydraulic fluid lost during the power stroke. Once the piston assembly reaches the end of the return stroke, the piston begins to move forward again and the hydraulic fluid in the piston chamber attempts to escape through the hydraulic fluid inlet and forces the ball of the reload check valve back against the valve seat to close the hydraulic fluid inlet. Until the ball moves from the open to the closed position, the pressure in the piston chamber cannot begin its buildup as the piston begins its power stroke. It should be noted that the distance the ball moves from the open to the closed positions is referred to as ball lift, see FIG. 8.

Since the time that the reload check valve is open is relatively short under pressure feed conditions, the reload check valve in these prior diaphragm pumps was designed with a ball lift that was large enough to ensure sufficient flow of hydraulic fluid into the piston chamber to completely replenish the hydraulic fluid lost during the power stroke (see FIG. 8). However, by designing a sufficient ball lift to ensure complete reload of the piston chamber, the closure time for the reload check valve is such that the piston begins accelerating to achieve a noticeable portion of its maximum velocity during the power stroke before the reload check valve closes. As shown in the graph in FIG. 19, the reload check valve does not close and allow pressure build up to begin in the piston chamber until the input shaft of the wobble plate has already rotated through approximately 1/10th of the power stroke (18°) with the piston reaching approximately 30% of its maximum velocity (line B). In other words, the piston velocity is rapidly increasing before the reload check valve closes and the pressure build up can begin. Until the reload check valve closes, the hydraulic fluid in the piston chamber is not experiencing any pressure build up and has substantially zero velocity. Once the reload check valve closes, the already accelerating piston "slams" against the body of hydraulic fluid in the piston chamber to begin pressure build up. Due to the increasing velocity of the piston at the beginning of pressure build up, the piston chamber experiences severe oscillations in pressure. The severe pressure oscillations or "pressure rings" reach peak pressures of more than three times the expected pressure in the piston chamber during the power stroke, as shown in the graph in FIG. 19.

Another factor that serves to accentuate the severity of these pressure rings stems from the introduction of air into the piston chamber. If the hydraulic fluid in the hydraulic fluid source is intermixed within any air when it flows into the piston chamber to reload the hydraulic fluid lost in the piston chamber, this will also affect the pressure build up during the power stroke. After the piston begins its power stroke and the reload check valve closes, the piston can begin pressure build up in the piston chamber. However, if there is air intermixed with the hydraulic fluid in the piston chamber, the movement of the piston during the power stroke will first compress the air, a highly compressible substance, before it can begin pressure build up of the hydraulic fluid, a substantially incompressible substance. Thus, the time it takes to compress any air contained in the piston chamber increases the delay from the time the piston starts its power stroke to when pressure build up begins. This added delay allows the piston velocity to increase even further before the beginning of pressure build-up which increases the severity of the pressure rings experienced in the piston chamber during the power stroke.

The problem of hydraulic fluid intermixed with air results from the location of the hydraulic fluid source. As previously discussed, the hydraulic fluid is stored in the chamber adjacent the piston assembly, which also houses the reciprocating mechanism or wobble plate. Typically, this chamber is filled with hydraulic fluid such that the entire wobble plate mechanism is covered. However, a certain amount of free air exists between the top surface of the hydraulic fluid and the top of the wobble plate chamber (see FIG. 17). This is necessary so that as the hydraulic fluid heats up upon operation of the wobble plate mechanism, the hydraulic fluid has room to expand within the wobble plate chamber without overflowing out the vent in the hydraulic fluid fill tube.

During operation of the pump, the rotation of the wobble plate mechanism vigorously stirs up the hydraulic fluid in the wobble plate chamber such that it mixes with any free air present in the chamber. The result is a frothy mixture of hydraulic fluid and air within the wobble plate chamber. When the hydraulic fluid from the wobble plate chamber enters the inlet to reload the piston chamber, this compressible hydraulic fluid-air mixture flows into the piston causing air entrapment in the piston chamber with the resulting effects described above.

Another significant problem with the prior diaphragm pumps under pressure feed conditions concerns the impact of the ball with the valve seat in the reload check valve. As discussed above, under pressure feed conditions, the reload check valve is closed during the power stroke and during most of the return stroke until the diaphragm impacts the diaphragm stop and the piston moves an additional short distance to complete the return stroke. During this short period, the reload check valve opens to allow hydraulic fluid into the piston chamber and then quickly closes as the piston begins its power stroke. The ball of the reload check valve is driven to the open position and then forced right back to its closed position against the inner edge of the valve seat. (See FIGS. 8, 91). A typical time for refill in these prior diaphragm pumps is approximately 0.005 seconds. Due to the short time period for refill, the ball of the reload check valve develops high velocities in both opening and closing of the valve. In particular, the closure velocity for the ball under pressure feed conditions is high enough that it leads to damage of the valve seat and ball. The ball is able to achieve these high velocities due in part to the ball lift distance which is large enough to allow sufficient flow of hydraulic fluid for a complete reload as discussed above (see FIGS. 8, 9). The high closure velocity of the ball results in high impact forces between the ball and the inner edge of the valve seat (see FIG. 8). This causes chipping of the inner edge of the valve seat and damage to the ball as well. Similar to the diaphragm stop chipping, these chips from the inner edge of the valve seat are transported by the hydraulic fluid into the piston chamber where there are no effective means for the chips to escape. Thus, these chips from the valve seat reside in the piston chamber for an extended period and cause damage to various piston components.

As shown in FIG. 8, the reload check valve of these prior diaphragm pumps is designed such that the ball impacts the inner edge of the valve seat to close the valve. The valve seat is sloped slightly toward its inner edge to direct the ball toward the inner edge of the valve seat while still permitting sufficient flow around the ball for hydraulic fluid reload as shown in FIG. 9. Due to the relatively large ball lift, the ball is also able to move around within the reload check valve as it is driven between the open and closed position such that it may impact the inner edge of the valve seat at varying angles resulting in increased chipping of the valve seat.

An additional problem with these prior diaphragm pumps concerns partial reload of hydraulic fluid under pressure feed conditions. As discussed above, the reload check valve is designed with sufficient ball lift to provide adequate flow of hydraulic fluid into the piston chamber during the short time period for reload. However, in actual operation, these pumps tend to run rough under pressure feed conditions indicating that only partial reload is occurring. This is believed to be due to the circular port or opening of the cylinder housing of the piston which connects the hydraulic fluid inlet with the piston chamber (see FIG. 15). This circular shape of the port does not allow sufficient flow into the piston chamber to ensure that complete reload is achieved under pressure feed conditions. Partial reload results in a loss of flow delivery for the pump since the piston is not transferring maximum displacement to the pumping chamber. It should be noted that partial reload is not a problem under vacuum feed conditions since the piston assembly is able to reload hydraulic fluid throughout the entire length of the return stroke.

Another problem involves pump flow under intermediate pressure flow conditions. In actual operation, these prior diaphragm pumps experience a fall off in pump flow at intermediate pressure feed. This is believed to be caused by the closure time of the reload check valve. Due to the relatively large ball lift required to ensure adequate hydraulic fluid flow for reload, the closure time is such that a noticeable portion of hydraulic fluid escapes from the piston chamber back up the inlet into the hydraulic fluid source before the reload check valve can close. This reduces the amount of hydraulic fluid in the piston chamber during the power stroke thus reducing the displacement of the pumping chamber by the diaphragm. This results in reduced flow of the pump under intermediate pressure feed conditions.

What is needed is an improved diaphragm pump for use under pressure feed conditions that minimizes the severe pressure oscillations within the piston chamber as the pressure builds up during the power stroke and further eliminates reload check valve damage and diaphragm stop or plunger damage to minimize the amount of debris within the piston chamber while still ensuring complete reload of hydraulic fluid to the piston chamber to maintain maximum efficiency of the pump.

SUMMARY OF THE INVENTION

The present invention provides an improved diaphragm pump for use under pressure feed conditions having a piston adapted for reciprocal movement, a flexible diaphragm, a pumping chamber on one side of the diaphragm, a piston chamber on the other side of the diaphragm, a source of hydraulic fluid connected with the piston chamber to allow hydraulic fluid into the piston chamber, hydraulic fluid in the piston chamber serving to transfer motion of the piston to the diaphragm, and a piston reciprocating mechanism.

According to one aspect of the present invention, the piston assembly includes a plurality of piston inlets connecting the hydraulic fluid source with the piston chamber and a plurality of check valves disposed within the inlets. The check valves are preferably ball valves having a ball and valve seat with the ball valve moveable between a closed position and open position such that the ball is disposed in contacting relationship against the valve seat when the ball valve is in the closed position. The valve seat includes a conical section sloped inward toward the hydraulic fluid inlet and has an inner edge adjacent to the inlet. The slope of the conical section is such that the tangential contact point between the ball and valve seat when the ball valve is in the closed position is located at a position on the conical section outward from the inner edge of the valve seat. Further, the distance the ball is permitted to move between the open and closed positions is such that the ball valve closes substantially in conjunction with the piston beginning its power stroke and the ball is not able to generate a high closure velocity when moving from the open to the closed position.

According to another aspect of the present invention, the piston assembly includes a diaphragm stop for limiting movement of the diaphragm away from the pumping chamber with the diaphragm stop having an inner edge portion. A diaphragm plunger is preferably provided which contacts the diaphragm stop during the return stroke of the piston under a pressure feed condition. The plunger includes a spherical surface portion such that the spherical surface portion impacts the diaphragm stop at a position outward from the inner edge of the diaphragm stop and inward from the outer edge of the plunger to prevent contact at the fragile edges and eliminate a source of wear debris.

The diaphragm pump preferably includes a piston reciprocating chamber adjacent the piston with the hydraulic fluid source located within the piston reciprocating chamber. The pump preferably includes an isolation reservoir adjacent and connected to the piston reciprocating chamber such that the hydraulic fluid completely fills the piston reciprocating chamber and further flows into the isolation reservoir to form an upper surface of a hydraulic fluid within the isolation reservoir.

According to another aspect of the present invention, the piston assembly includes a sliding valve responsive to the relative movement between the diaphragm and the piston for controlling the flow of hydraulic fluid from the hydraulic fluid source into the piston chamber. The sliding valve includes a cylinder valve connected to the diaphragm and a cylinder valve housing connected to the piston and adapted to receive the cylinder valve therein. The cylinder valve housing includes at least one elongated slot disposed adjacent the cylinder valve to permit the flow of hydraulic fluid into the piston chamber.

The above-described features and advantages, along with various other advantages and features of novelty, are pointed out with particularity in the claims of the present application which form a part hereof. However, for a better understanding of the invention, its advantages, and objects obtained by its use, reference should be made to the drawings which form a further part of the present application and to the accompanying descriptive manner in which there is illustrated and described preferred embodiments of the invention.

BRIEF DESCRIPTION OF THE DRAWINGS

FIG. 20 is a graph of the pressure in the piston chamber of a prior diaphragm pump as a function of the rotation of the input shaft of the wobble plate through several piston cycles under pressure feed conditions;

DETAILED DESCRIPTION OF THE INVENTION

Figure 16:
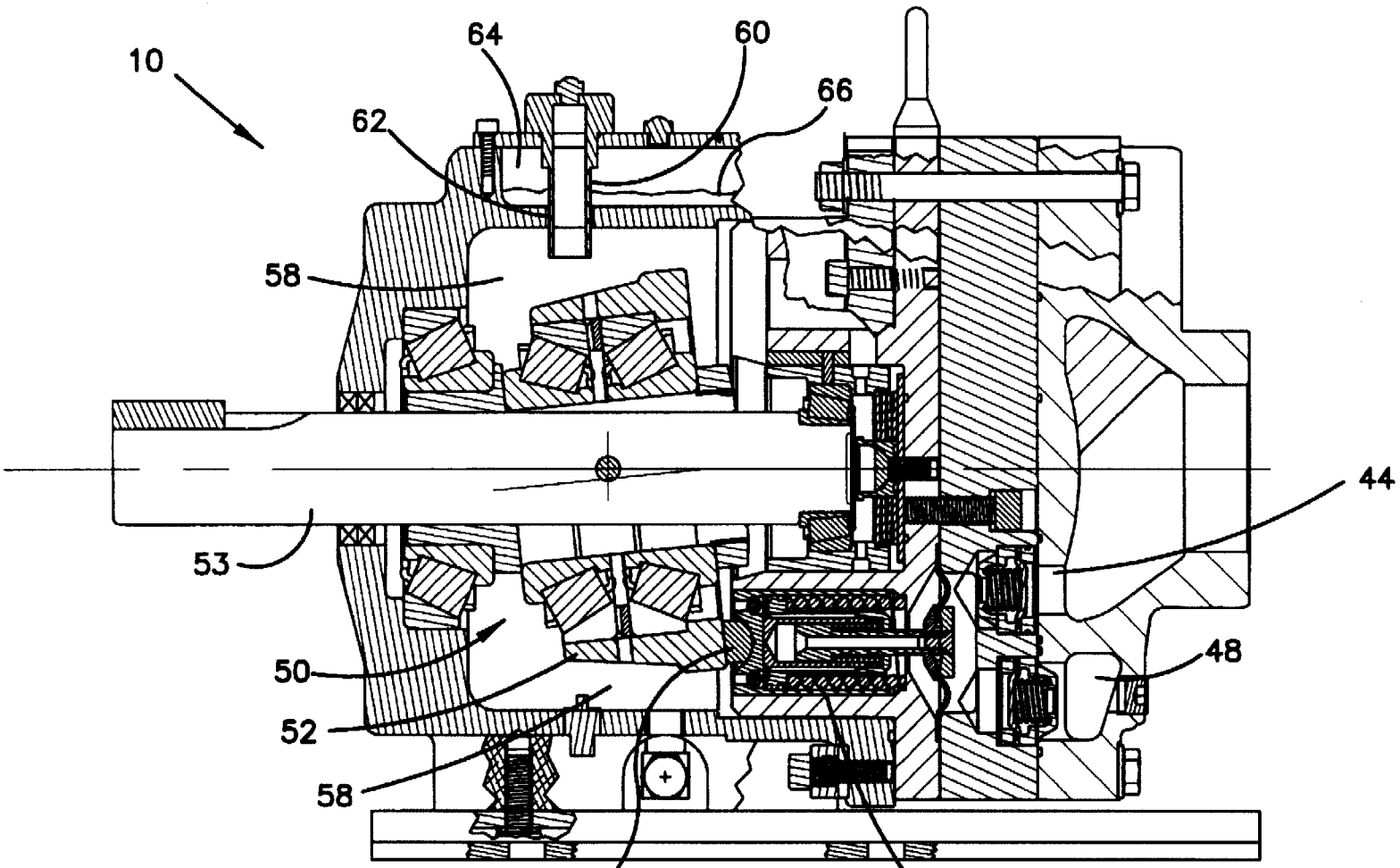
FIG. 16 is a cross sectional view of a diaphragm pump according to the principles of the present invention.

Referring now to the drawings in which similar elements are numbered identically throughout, a description of preferred embodiments is provided. In FIG. 16, a cross sectional view of a diaphragm pump according to the principles of the present invention is generally illustrated at 10.

Figure 1:
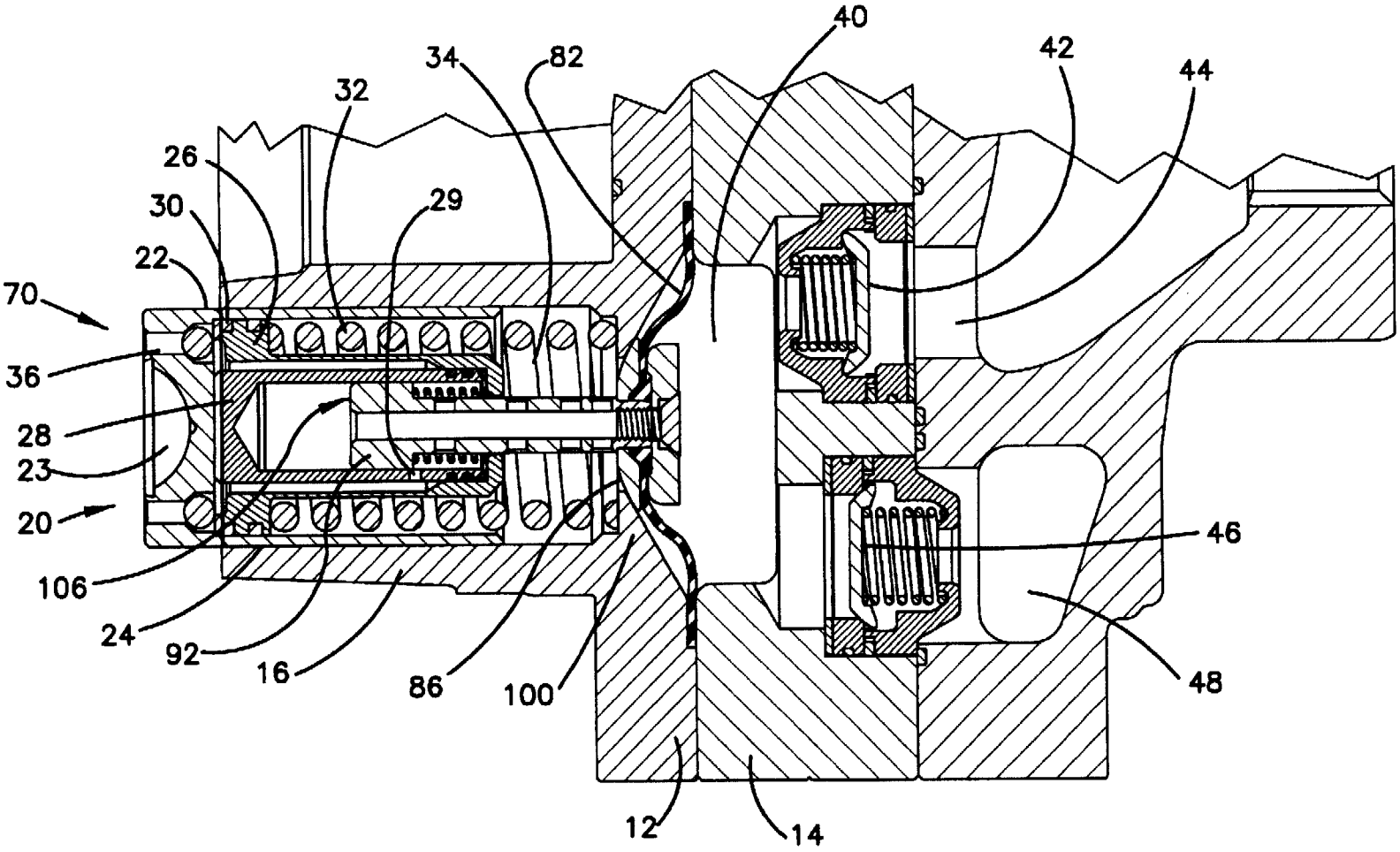
FIG. 1 is a cross sectional view of a piston assembly in accordance with the principles of the present invention with the piston and diaphragm in a first position at the completion of the return stroke under pressure feed conditions and just prior to the power stroke (bottom dead center)

Referring to FIG. 1, the diaphragm pump of the present invention includes a piston assembly which is adapted for use in a high pressure, hydraulically balanced, multi-pistoned diaphragm pump of the type described in U.S. Pat. No. 3,884,598. The apparatus of the present invention includes a piston assembly movable between a first and second position, a diaphragm assembly movable between a first and second position in response to the movement of the piston assembly, and a pumping assembly in which pumping fluid is drawn into a pumping chamber through an inlet passage and forced out through a discharge passage in response to the movement of the diaphragm. More specifically, the piston assembly includes a relatively cylindrical piston 20 comprising an end section 22 and a piston sleeve section 24 integrally formed with the end section 22 and extending downward from the outer edge of the end section 22 (see FIG. 1). A base section 26 is connected with the interior surface of the piston sleeve 24 in a sealing relationship by the seal 30 so that the base section 26 is movable with the end and sleeve sections 22, 24. The piston 20 is adapted to slidably fit within a piston cylinder 16 which is integrally formed with the pump casting 12 and whose inner cylindrical surface approximates the outer cylindrical surface of the piston sleeve section 24 to substantially prevent the flow of hydraulic fluid from the piston chamber 34, defined in part by the interior of the piston 20, between the outer surface of the sleeve section 24 and the inner surface of the piston cylinder 16 during a reciprocation of the piston 20 (see FIG. 1). It should be noted that although the close fitting relationship between the sleeve section 24 and the cylinder 16 is sufficiently tight so that reciprocating movement of the piston 20 causes corresponding reciprocal movement of the diaphragm assembly 80 as will be discussed below, the fitting between such surfaces is loose enough to allow a limited amount of hydraulic fluids to leak from the piston chamber 34 during the downward movement or power stroke of the piston 20. This controlled leakage serves to lubricate the sliding surfaces of the sleeve section 24 and the cylinder 16 and to aid in cooling the piston chamber fluid when such fluid is replenished.

Figure 2:
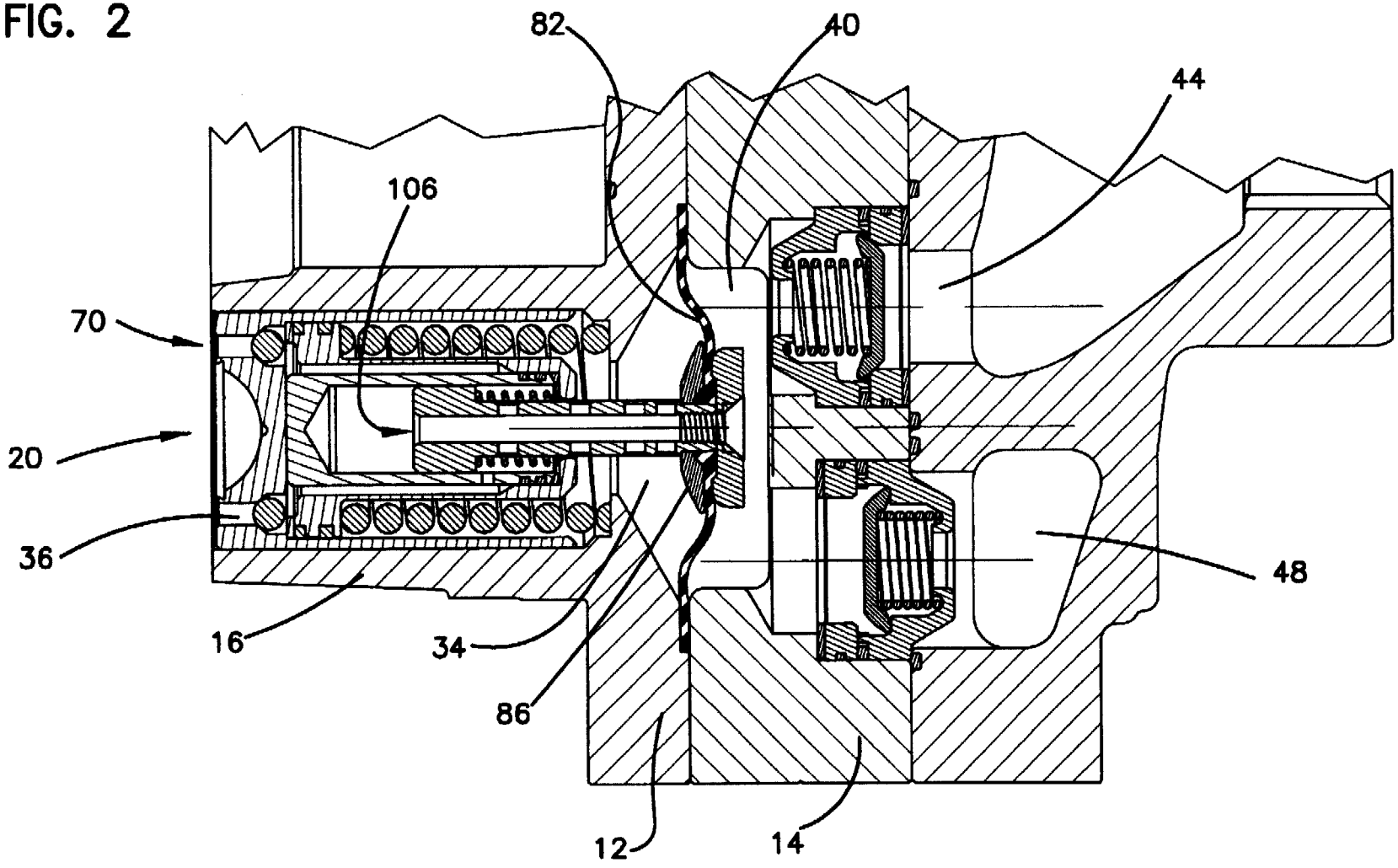
FIG. 2 is a cross sectional view of the piston assembly shown in FIG. 1 with the piston and diaphragm in a second position at the completion of the power stroke under pressure feed conditions and just prior to the return stroke.

Referring to FIG. 16, a reciprocating mechanism 50 is provided to reciprocate the piston 20 between a first position and a second position. A cam or wobble plate 52 is provided which is canted with respect to the center line of shaft 53. A hemispherical foot 56 is disposed in a corresponding recess 23 in the upper surface of the piston end section 22 with the hemispherical foot 56 adapted to slidably engage the lower surface of the cam or wobble plate 52 to transfer the reciprocating motion of the wobble plate 52 to the piston 20. During operation of the pump, the wobble plate 52 reciprocates to cause a corresponding reciprocation of the piston 20. FIGS. 1 and 2 illustrate the upper and lower position of the piston 20 as it moves between the power stroke and return stroke. After the piston's downward movement from the position in FIG. 1 to that in FIG. 2 (power stroke), the piston 20 is returned to the position of FIG. 1 (return stroke) by a coil spring 32 which has one end supported by the base section 26 of the piston 20 and the other end supported by a portion of the piston cylinder 16.

The wobble plate mechanism 50 is disposed in a wobble plate chamber 58 of the pump. The wobble plate chamber is filled with hydraulic fluid which serves to lubricate the wobble plate mechanism 50 as well as to provide a hydraulic fluid source adjacent the end section 22 of the piston 20 (see FIG. 16). The piston 20 includes a hydraulic fluid inlet 36 to connect the wobble plate chamber 58 with the piston chamber 34. A reload check valve 70 is disposed within the inlet 36 to permit the flow of hydraulic fluid into the piston chamber 34 when the pressure in the piston chamber is less than the pressure in the wobble plate chamber 58 and to prevent the flow of hydraulic fluid into the piston chamber 34 when the pressure in the piston chamber 34 is greater than the pressure in the wobble plate chamber 58. In this way, the reload check valve is closed during the power stroke and is open during at least a portion of the return stroke to allow replenishing of any hydraulic fluid lost from the piston chamber between the piston sleeve section 24 and the piston cylinder 16 during the power stroke.

Figure 5:
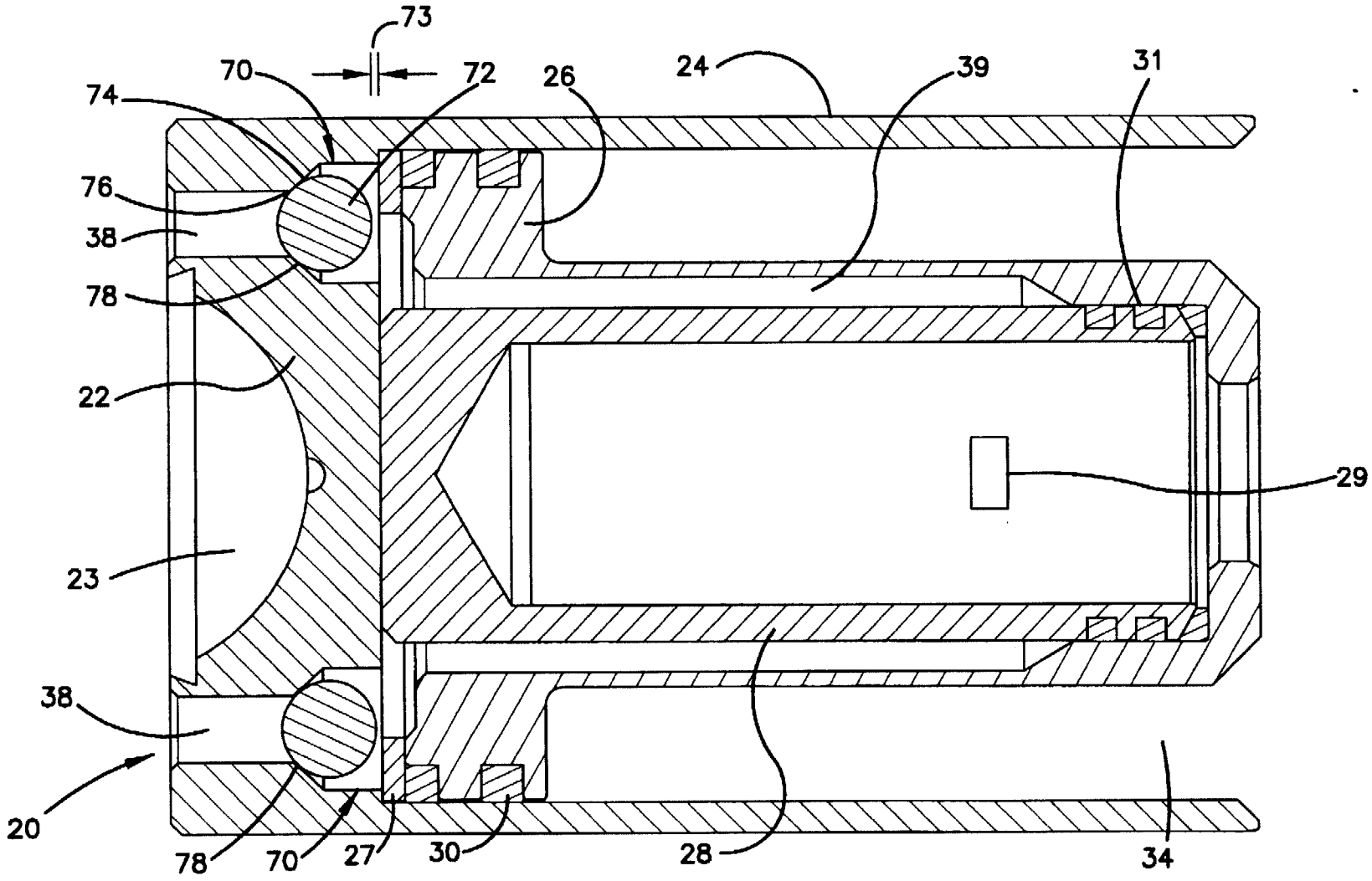
FIG. 5 is a cross sectional view of the piston assembly according to the principles of the present invention with the ball valves shown in the closed position.

As shown in FIG. 5, the hydraulic fluid inlet 36 includes an upper section 38 formed in the end section 22 of the piston 20. The reload check valve 70 which includes a ball 72 and valve seat 74 is disposed adjacent the upper section 38 of the hydraulic fluid inlet 36 (see FIGS. 5, 6). A ball stop member 27 is disposed adjacent the reload check valve 70 between the end section 22 and base section 26 of the piston 20. This ball stop member 27 forms the base of the reload check valve 70 against which the ball 72 of the reload check valve 70 rests when the check valve is in the open position. The base section 26 of the piston 20 is adapted to receive a cylinder valve housing 28 within the interior of the base section 26. The outer surface of the cylinder valve housing 28 is dimensioned such that there exists a small gap between the cylinder valve housing 28 and the base section 26 which forms a hollow cylindrical sleeve 39 (see FIGS. 5, 6). The outer wall of the cylinder valve housing 28 includes an opening 29 adjacent the cylindrical hollow sleeve. The cylindrical hollow sleeve is disposed adjacent to the reload check valve 70 and forms a lower section 39 of the hydraulic fluid inlet 36 such that hydraulic fluid retained in the wobble plate chamber 58 can flow through the inlet upper section 38, around the reload check valve 70, down the lower section 39 of the inlet 36 and through the cylindrical valve housing opening 29 to reach the piston chamber 34. A lower seal 31 is provided to seal the bottom portion of the base section 26 and cylindrical valve housing 28.

Figure 12:
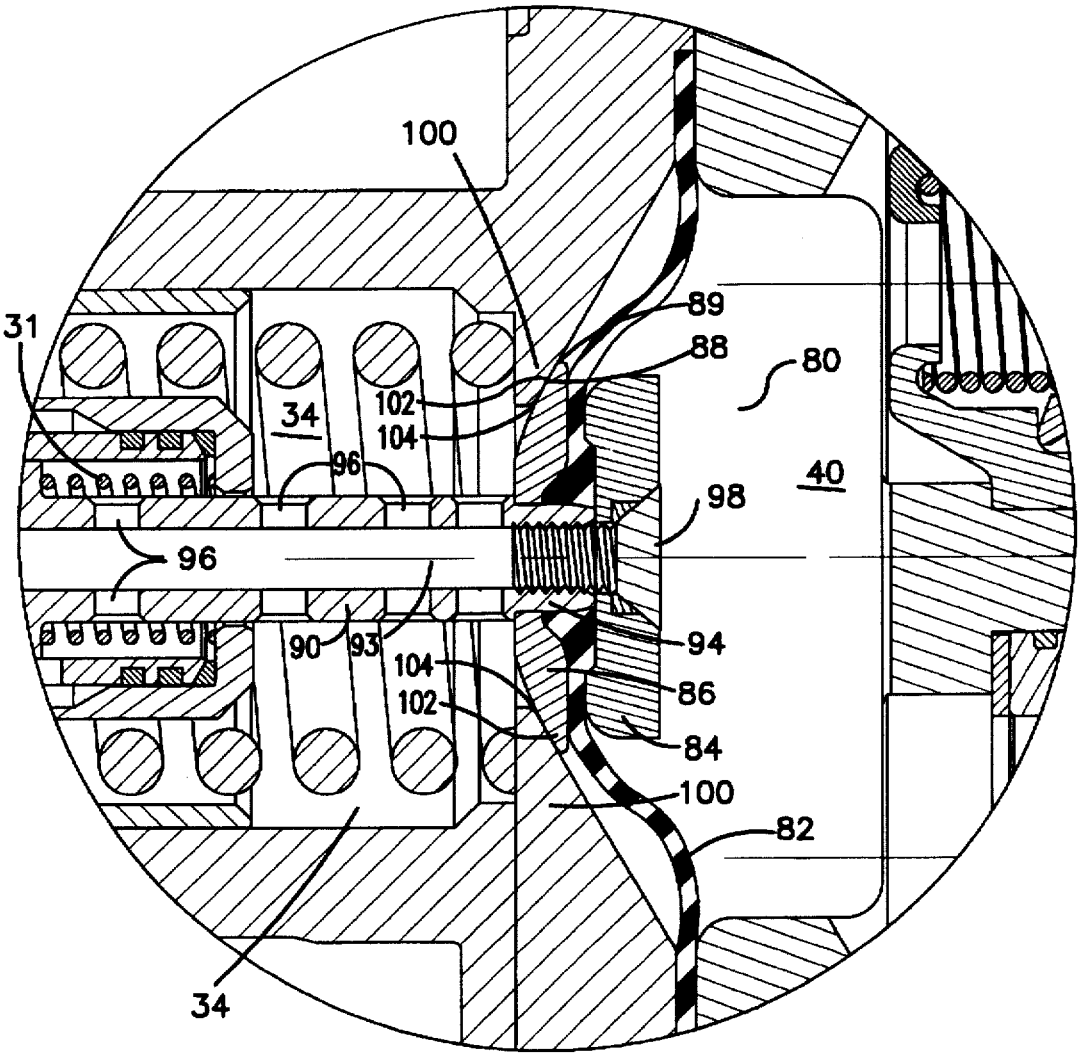
FIG. 12 is a cross sectional view of a portion of the piston assembly of FIG. 1 showing the diaphragm plunger in contact with the diaphragm stop.

As shown in FIGS. 1, 12, a diaphragm assembly 80 is disposed at and defines one end of the piston chamber 34 and includes a flexible diaphragm 82 disposed in a sealed relationship between the pump castings 12, 14, a base plate 84 secured to the bottom or pumping side of the diaphragm 82, a diaphragm plunger 86 disposed immediately above the diaphragm 82, and a diaphragm stem 90 extending upwardly from the diaphragm plunger 86 into the piston chamber 34. The diaphragm stem 90 includes an inner bore 93 with the lower end 94 having internal threads such that a screw 98 is inserted through the base plate 84 and diaphragm 82 for engagement with the lower end 94 of the diaphragm stem 90 to securely connect the diaphragm assembly 80.

Referring to FIG. 12, a diaphragm stop 100 is disposed adjacent the diaphragm assembly 80 within the piston chamber 34. The diaphragm stop 100 extends inward from the piston cylinder 16 and is positioned to engage a portion of the diaphragm 82 as the piston 20 approaches the end of its return stroke under pressure feed conditions. In particular, the diaphragm stop 100 includes an impact surface 102 disposed adjacent the diaphragm plunger 86. As will be discussed in more detail below, the diaphragm stop 100 is positioned to limit the movement of the diaphragm 82 toward the piston 20 which allows the piston chamber 34 to be replenished with hydraulic fluid lost during the power stroke when the pump is operating under pressure feed conditions.

The diaphragm stem 90 includes a cylinder head 92 formed at the upper portion of the diaphragm stem 90 which is disposed within the cylinder valve housing 28 of the piston 20. A spring 99 is disposed between the cylinder head 92 and the bottom of the cylinder valve housing 28 to bias the diaphragm assembly 80 toward the piston chamber 34 (see FIG. 12). The cylinder head 92 of the diaphragm stem 90 and the cylinder valve housing 28 of the piston 20 cooperate to form a sliding valve assembly 106 for controlling the flow fluid between the hydraulic fluid inlet 36 and the piston chamber 34 (see FIG. 2). The sliding valve assembly 106 is in the open position when the cylinder head 92 is disposed above the opening 29 in the cylinder valve housing 28, so that hydraulic fluid in the lower section 39 of the hydraulic fluid inlet 36 can enter into the piston chamber 34 through a plurality of apertures 96 connected to the inner bore of the diaphragm stem 90 (see FIG. 12). The sliding valve assembly is closed when the cylinder head 92 is disposed against and blocks the opening 29 in the cylinder valve housing 28 to prevent hydraulic fluid from entering the piston chamber 34 (see FIGS. 3, 4).

Disposed immediately below the diaphragm assembly 80 is a pumping chamber 40 and a pumping valve assembly. The pumping valve assembly includes an inlet valve 42 and discharge valve 46 which are oriented to allow fluid to flow from the supply conduit 44 in through the inlet valve 42 into the pumping chamber 40 and from the pumping chamber 40 out through the discharge valve 46 to the discharge conduit 48 (see FIGS. 1, 2). The basic cycle of the pump consists of the piston 20 moving through its return stroke in which pumping fluid is drawn from the supply conduit 44 into the pumping chamber 40 through the inlet valve 42 and the piston then moves through its power stroke with the hydraulic fluid in the piston chamber forcing the diaphragm 82 forward towards the pumping chamber 40 to displace the pumping fluid in the pumping chamber 40 and discharge the pumping fluid out the discharge valve 46 to the discharge conduit 48.

Figure 3:
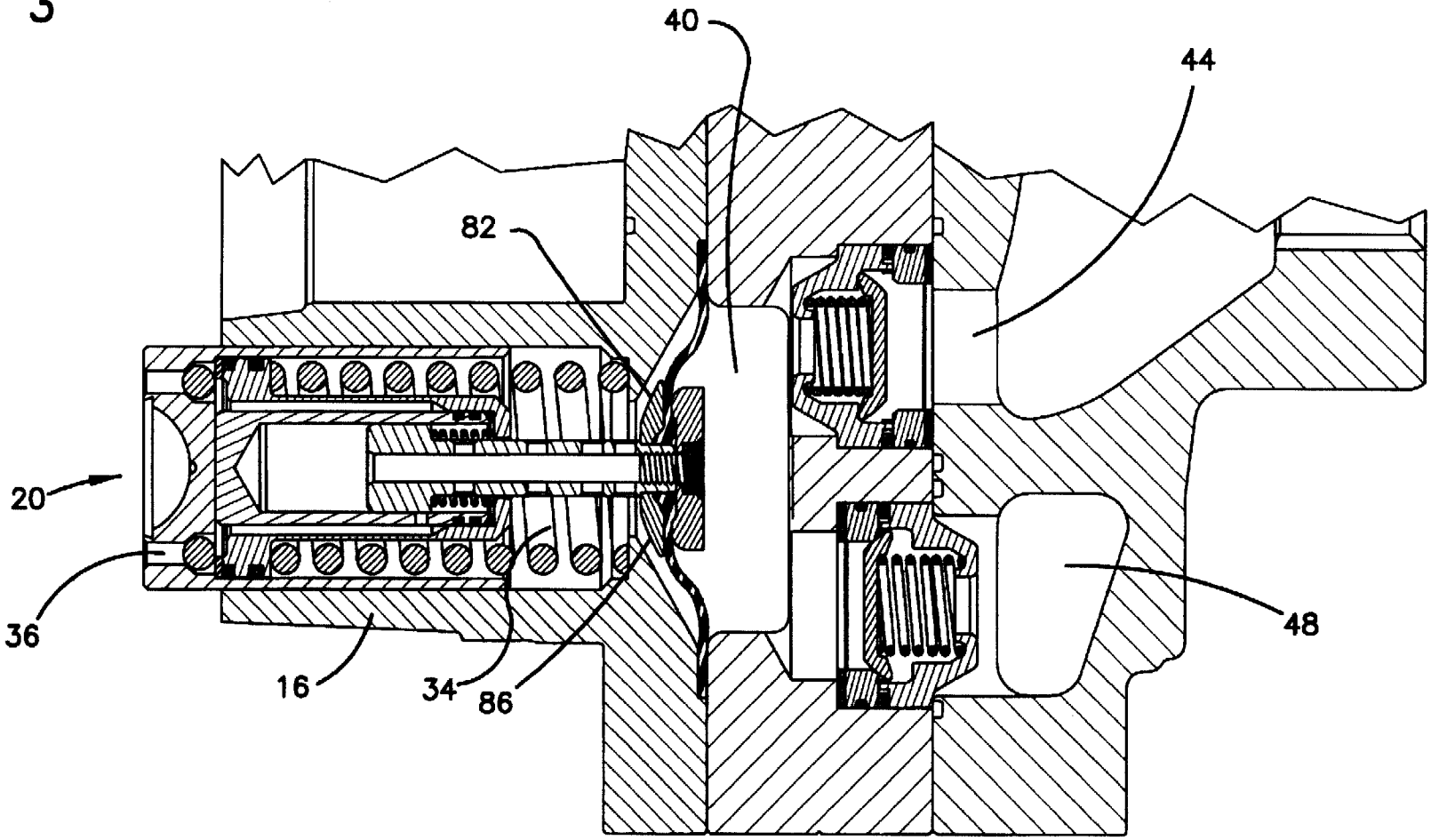
FIG. 3 is a cross sectional view of the piston assembly shown in FIG. 1 with the piston and diaphragm in the first position at the completion of the return stroke under vacuum feed conditions and just prior to the power stroke.
Figure 4:
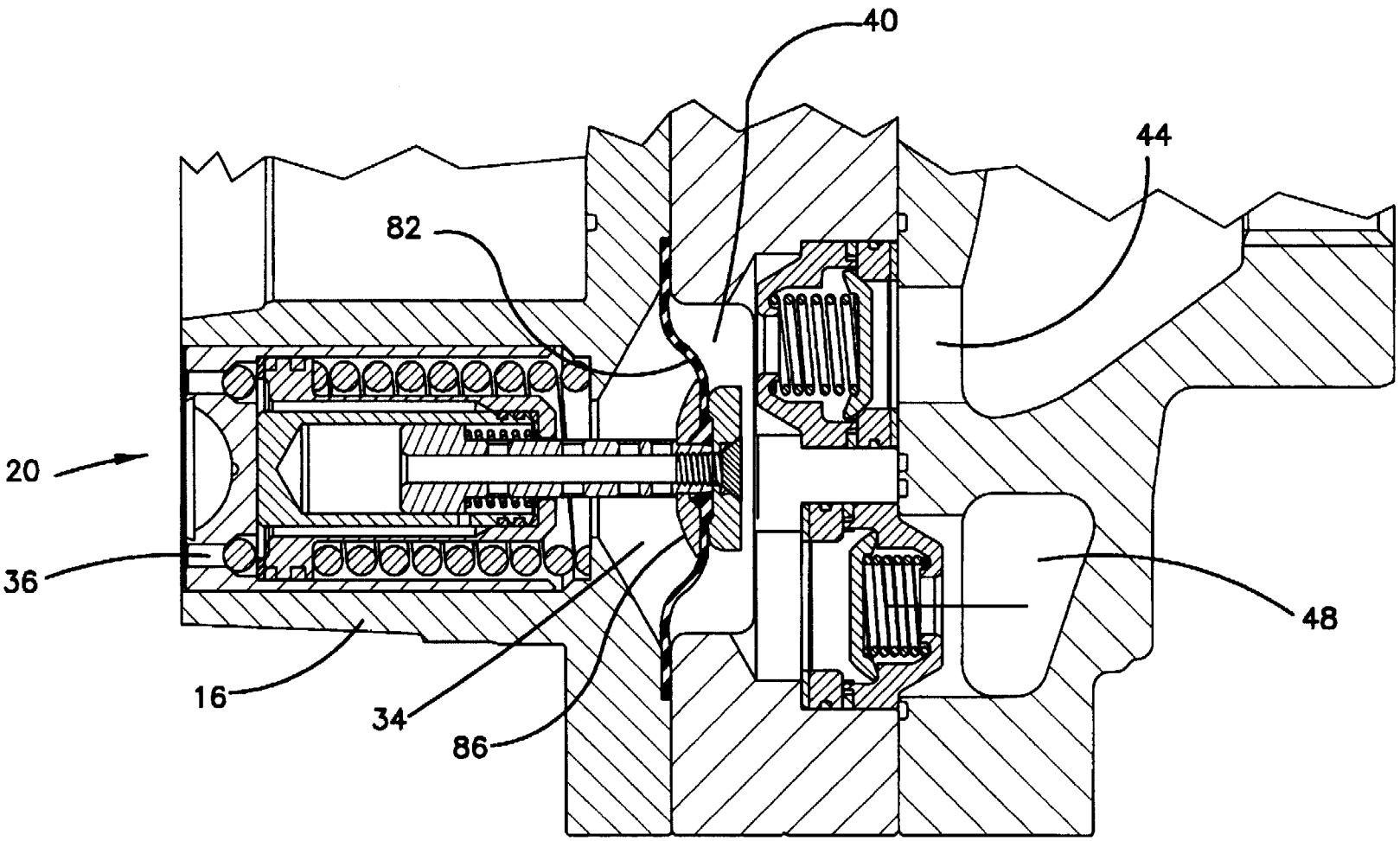
FIG. 4 is a cross sectional view of the piston assembly shown in FIG. 1 with the piston and diaphragm in a second position at the completion of the power stroke under vacuum feed conditions and just prior to the return stroke.

The above description of the general apparatus of the diaphragm pump of the present invention provides a pump well-suited for normal pump conditions i.e., vacuum feed conditions where the fluid to be pumped is not under pressure (see FIGS. 3, 4). The following description concerns particular preferred embodiments of the diaphragm pump of the present invention which are designed to improve reliability, performance and long-term wear of the diaphragm pump under pressure feed conditions, where the fluid to be pumped is supplied under pressure. It is appreciated that the diaphragm pump with these particular embodiments not only show significantly improved performance under pressure feed conditions but also is well suited for vacuum feed conditions.

It is helpful to first outline the performance characteristics of the diaphragm pump of the present invention under pressure feed conditions and then proceed with a description of the preferred embodiments. Under pressure feed conditions, the piston 20 and diaphragm assembly 80 reciprocate between the positions shown in FIGS. 1 and 2. During the power stroke, the reload check valve 70 is closed due to the force of the hydraulic fluid in the piston chamber 34 and lower section 39 of the hydraulic fluid inlet 36 against the ball 72 of the reload check valve 70 (FIG. 2). Even as the piston 20 reciprocates back on its return stroke, the reload check valve 70 remains closed as the pressure in the pumping chamber 40 (under pressure feed), and the corresponding pressure in the piston chamber 34, is still above atmospheric pressure, which is the pressure of the hydraulic fluid in the wobble plate chamber 58. As the piston 20 nears the end of the return stroke, the diaphragm assembly 80 impacts the diaphragm stop 100 to prevent further movement of the diaphragm 82 toward the piston 20 while the piston 20 continues back a short additional distance to complete the return stroke (FIG. 1). This allows the piston chamber 34 to depressurize below the pressure in the pumping chamber 40 and below the pressure of the hydraulic fluid in the wobble plate chamber 58 as well. The reload check valve 70 is then driven open by the force of the hydraulic fluid entering through the upper section 38 of the hydraulic fluid inlet 36 to reload any lost hydraulic fluid in the piston chamber 34. During this reload or replenishing period, the sliding valve assembly 106 is open with the diaphragm cylinder head 92 positioned above the opening 29 of the cylinder valve housing 28 to allow hydraulic fluid into the piston chamber 34 (see FIG. 1). It should be noted that under pressure feed conditions, the sliding valve assembly 106 generally remains in the open position and the reload check valve 70 remains closed for most of the entire reciprocation cycle.

After the piston 20 returns the short additional distance after the diaphragm assembly 80 contacts the diaphragm stop 100, the piston 20 begins its power stroke and the hydraulic fluid in the piston chamber 34 seeks to escape out the hydraulic fluid inlet 36 and consequently closes the reload check valve 70 so the piston chamber 34 can begin the pressure build up associated with the power stroke of the piston.

Figure 8:
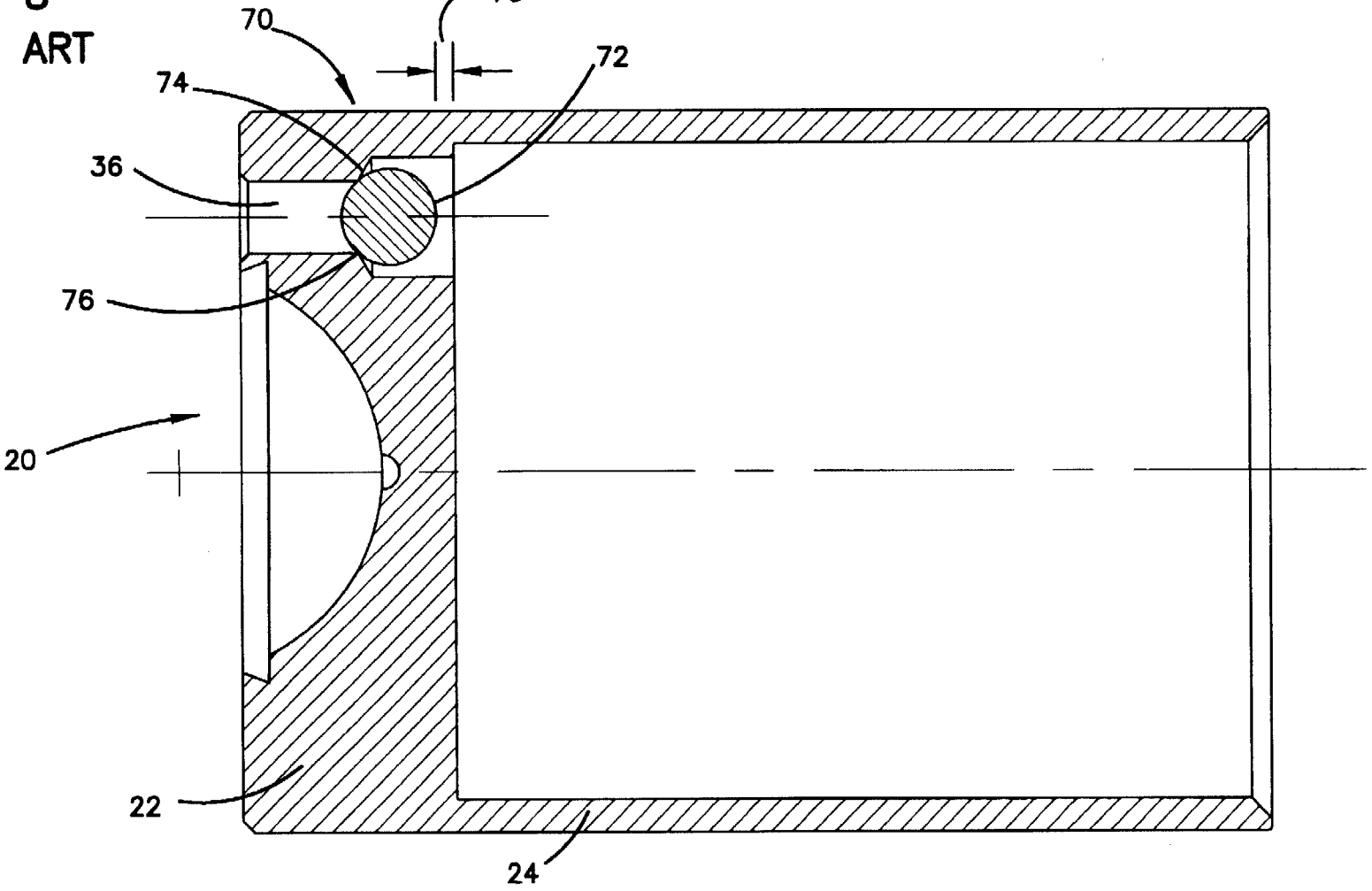
FIG. 8 PRIOR ART
FIG. 8 is a cross sectional view of a partial piston assembly of a prior diaphragm pump showing the ball valve in the closed position.
Figure 23:
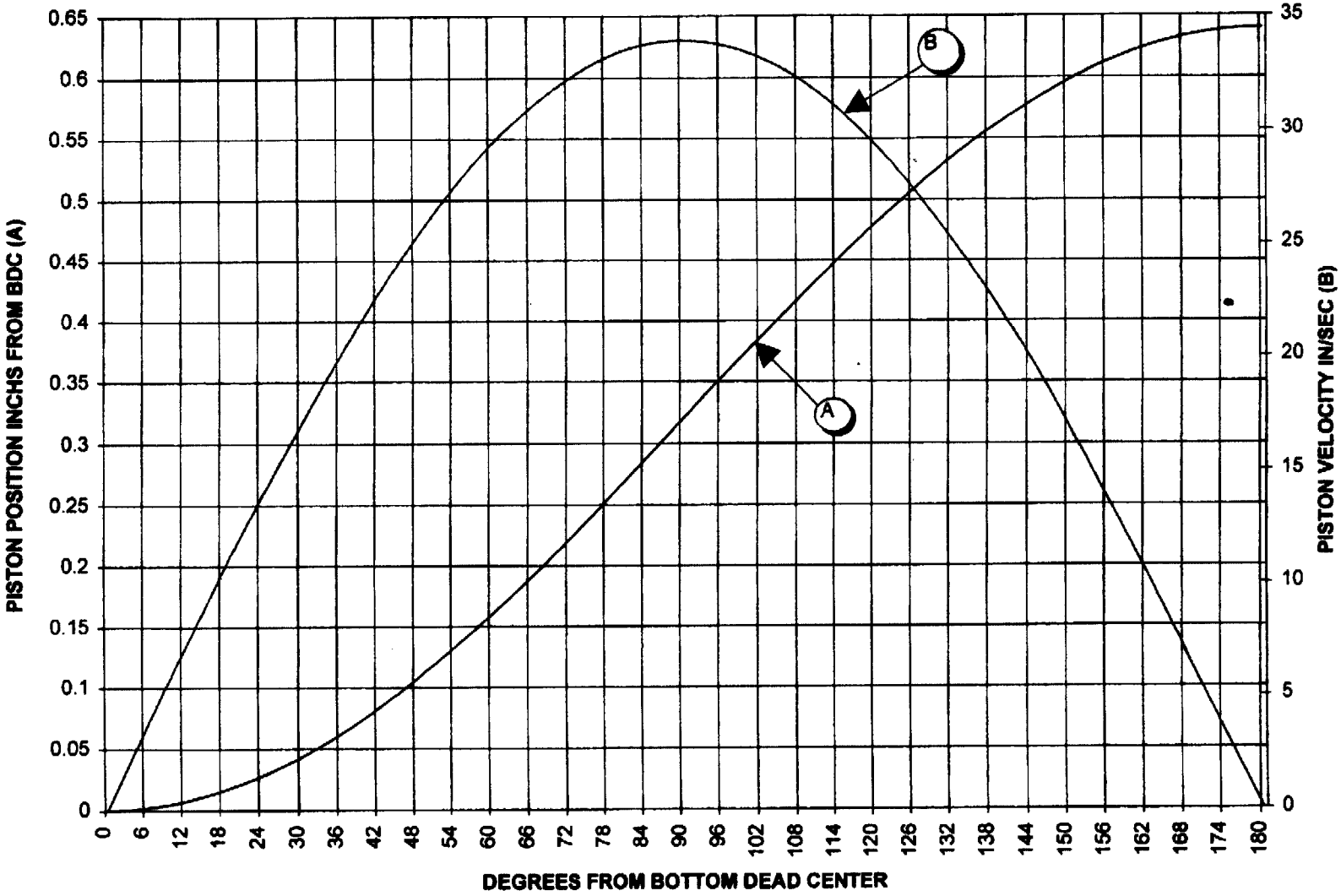
FIG. 23 is a graph of the piston position away from bottom dead center and piston velocity of a diaphragm pump according to the principles of the present invention as a function of the rotation of the input shaft of the wobble plate through the power stroke.

Pursuant to a preferred embodiment, the reload check valve 70 of the present invention is designed to facilitate quick closure of the reload check valve 70 while minimizing any potential damage to the ball 72 or valve seat 74. Referring to FIG. 5, the reload check valve 70 has a reduced ball lift 73 compared to prior diaphragm pumps (see FIG. 8). This reduces the time required for closure of the reload check valve 70 when the piston 20 begins its power stroke. By reducing the closure time of the reload check valve 70, the hydraulic fluid in the piston chamber 34 is able to begin pressure build up substantially in conjunction with the piston 20 beginning its power stroke. At this position, the piston velocity is still relatively low as the piston 20 is just beginning its acceleration through the power stroke (see FIGS. 18, 23). Consequently, the pressure peaks or pressure rings associated with the pressure build up in the piston chamber 34 are greatly reduced in the present invention as compared to prior diaphragm pumps with a larger ball lift. (See FIG. 19).

Figure 18:
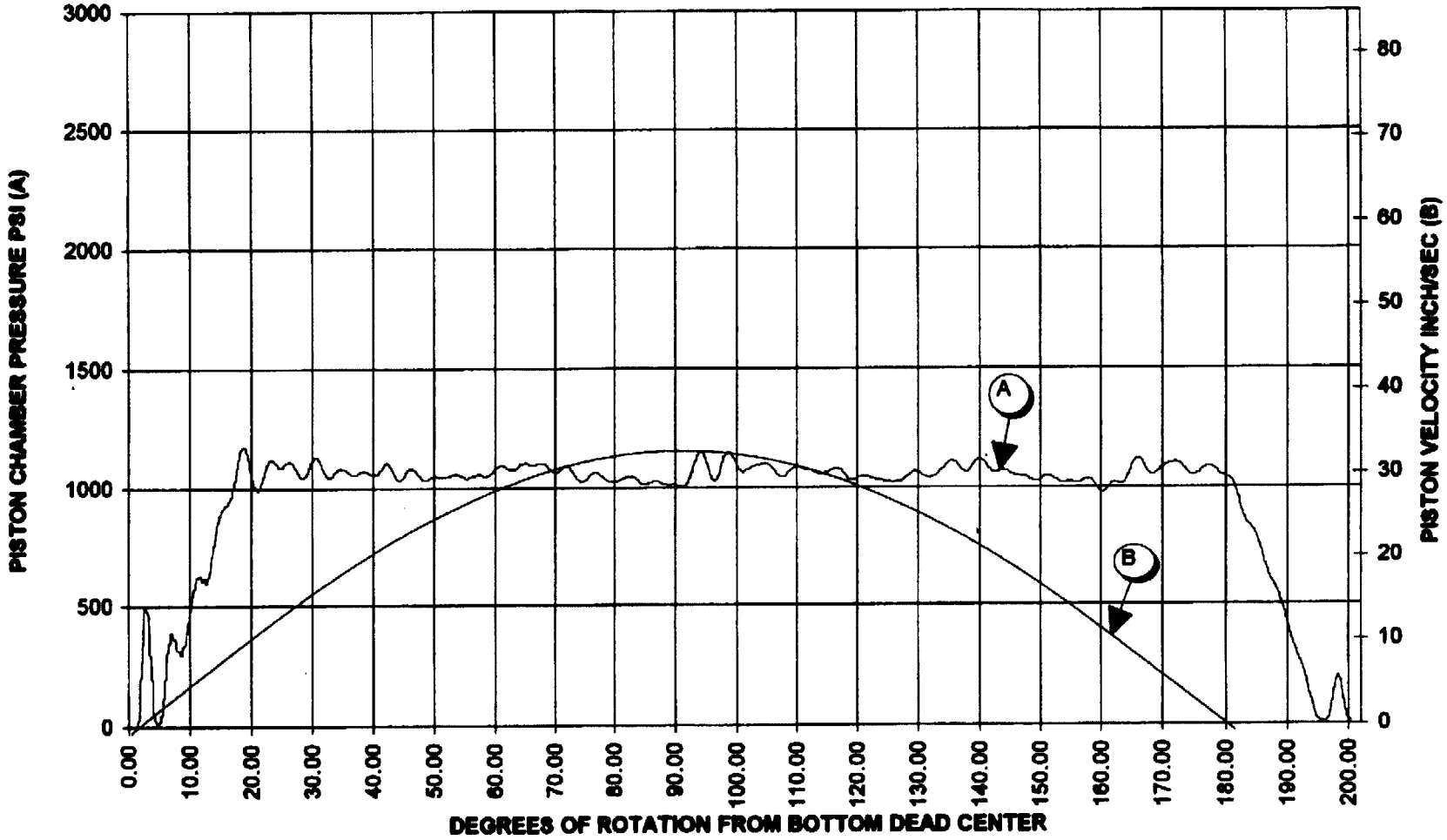
FIG. 18 is a graph of the pressure (line A) in the piston chamber of a diaphragm pump according to the principles of the present invention and the piston velocity (line B) as a function of the rotation of the input shaft of the wobble plate through the power stroke under pressure feed conditions.
Figure 19:
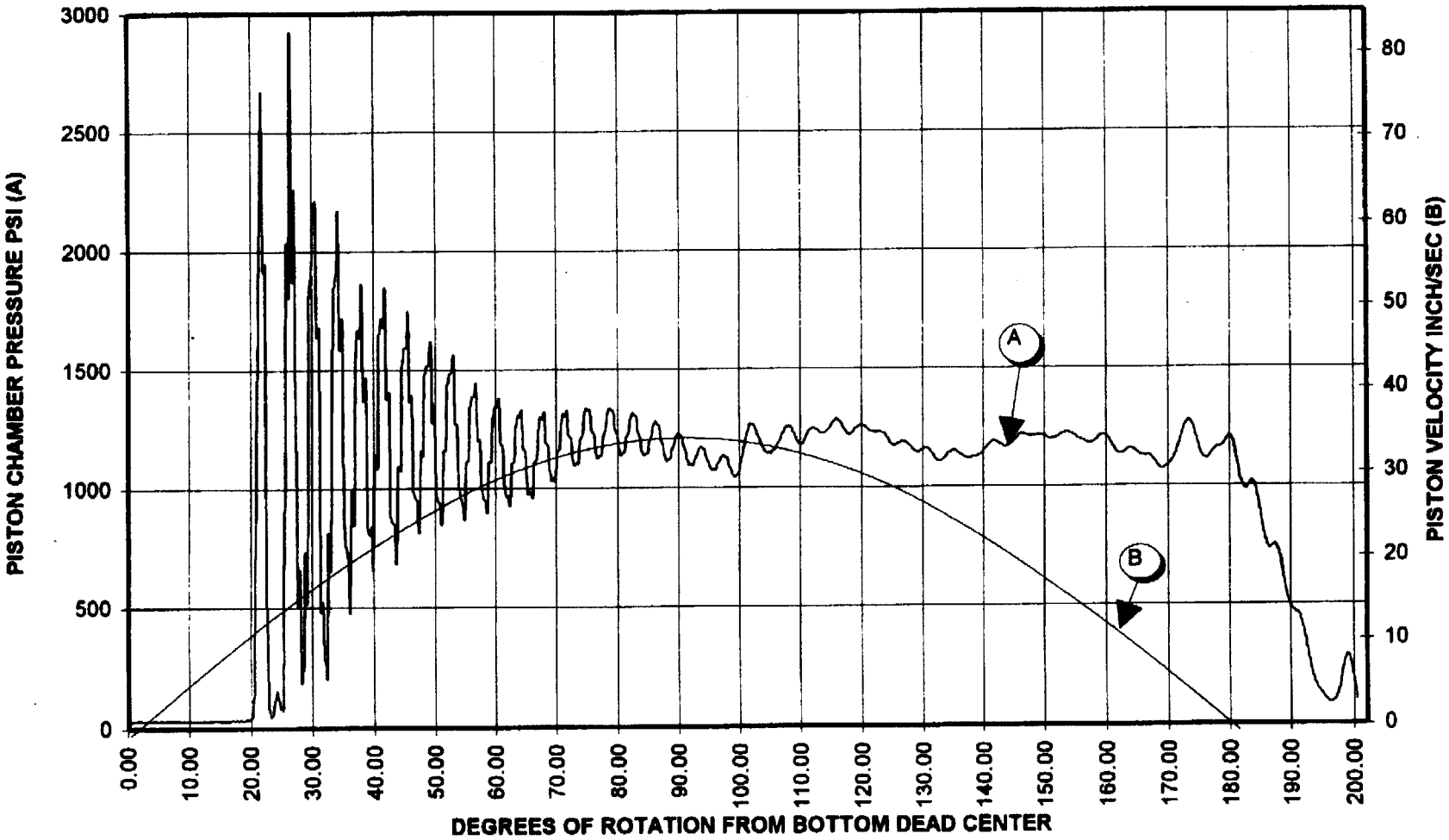
FIG. 19 PRIOR ART
FIG. 19 is a graph of the pressure (line A) in the piston chamber of a prior diaphragm pump and the piston velocity (line B) as a function of the rotation of the input shaft of the wobble plate through the power stroke under pressure feed conditions.
Figure 2O:
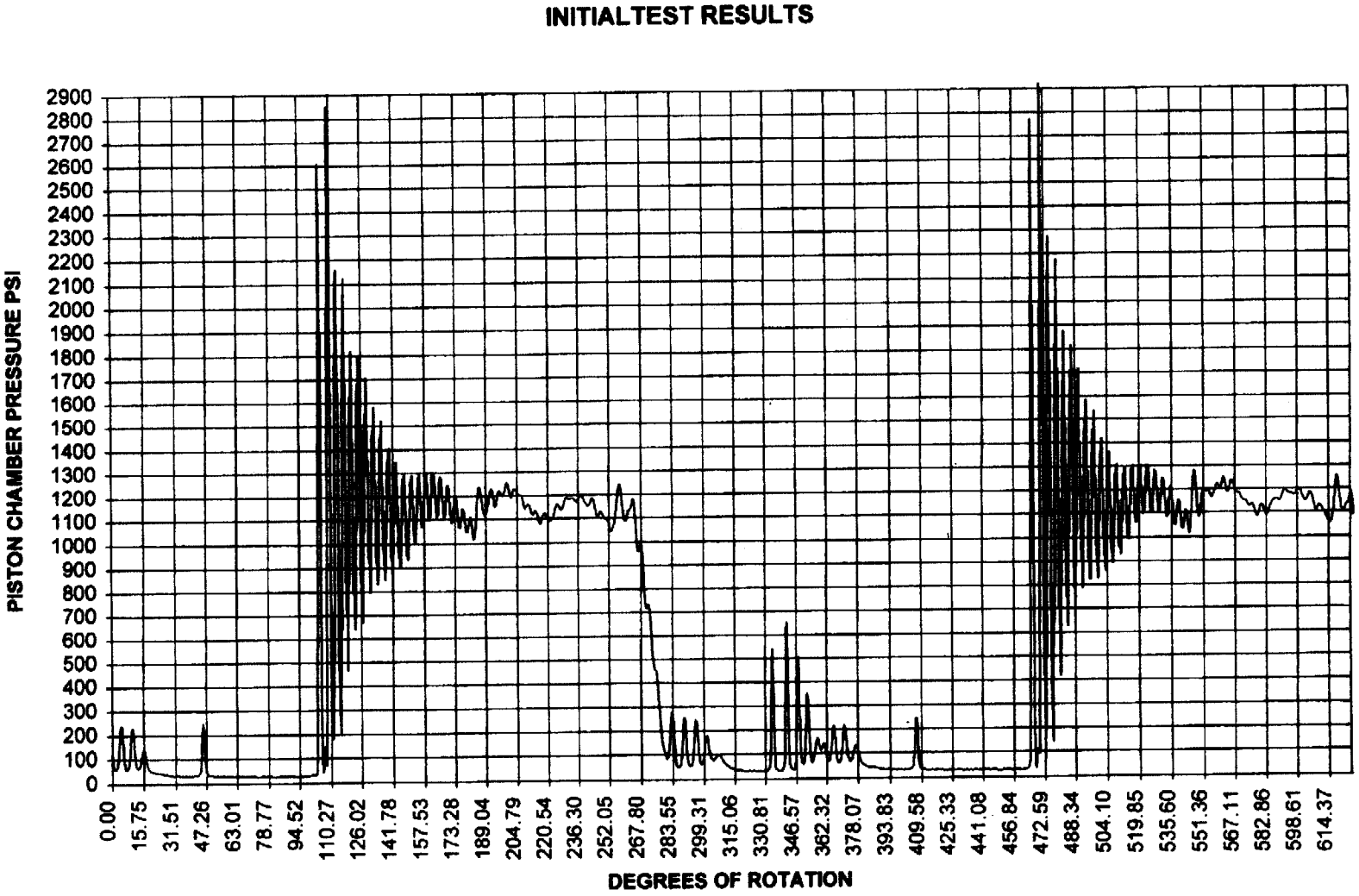
FIG. 2O PRIOR ART

The graph in FIG. 18 shows that pressure build up begins in the present invention substantially in conjunction with the piston 20 beginning its power stroke (within approximately 2 degrees of rotation of the input shaft 53 from bottom dead center). This is significantly quicker pressure build up as compared to the prior diaphragm pumps where the pressure build up would not begin until the input shaft 53 of the wobble plate mechanism 50 had already rotated through approximately 1/10th (or 18 degrees) of the power stroke (see graph in FIG. 19).

This reduced closure time also helps eliminate the problem of pump flow fall off under intermediate pressure conditions described previously. The reduced closure time means that less hydraulic fluid in the piston chamber 34 is able to escape out the inlet 36 before the reload check valve 70 closes at the start of the power stroke. The loss of less hydraulic fluid translates into better pump performance without noticeable flow fall off under intermediate pressure conditions. Furthermore, the reduced ball lift provides a better metering pump. By reducing the loss of hydraulic fluid back out the inlet 36, the volume of hydraulic fluid in the piston chamber 34 is maintained so that the displacement of the pumping chamber 40 per revolution is more consistent. This provides for better metering when it is necessary to know precisely how much pumping fluid has been delivered through the pump.

Another consequence of the reduced ball lift 73 in the reload check valve 70 is lower ball closure velocity. Since the ball 72 has a shorter distance to travel from the open to the closed position against the valve seat 74, the ball 72 is not able to achieve as high a closure velocity as in prior diaphragm pumps with larger ball lifts (see FIG. 8). This reduced closure velocity of the ball 72 results in lower impact forces when the ball 72 contacts the valve seat 74 to close the reload check valve 70. This lower closure velocity is not high enough to cause valve seat and ball damage as found in the prior diaphragm pumps having higher closure velocities discussed previously.

Figure 6:
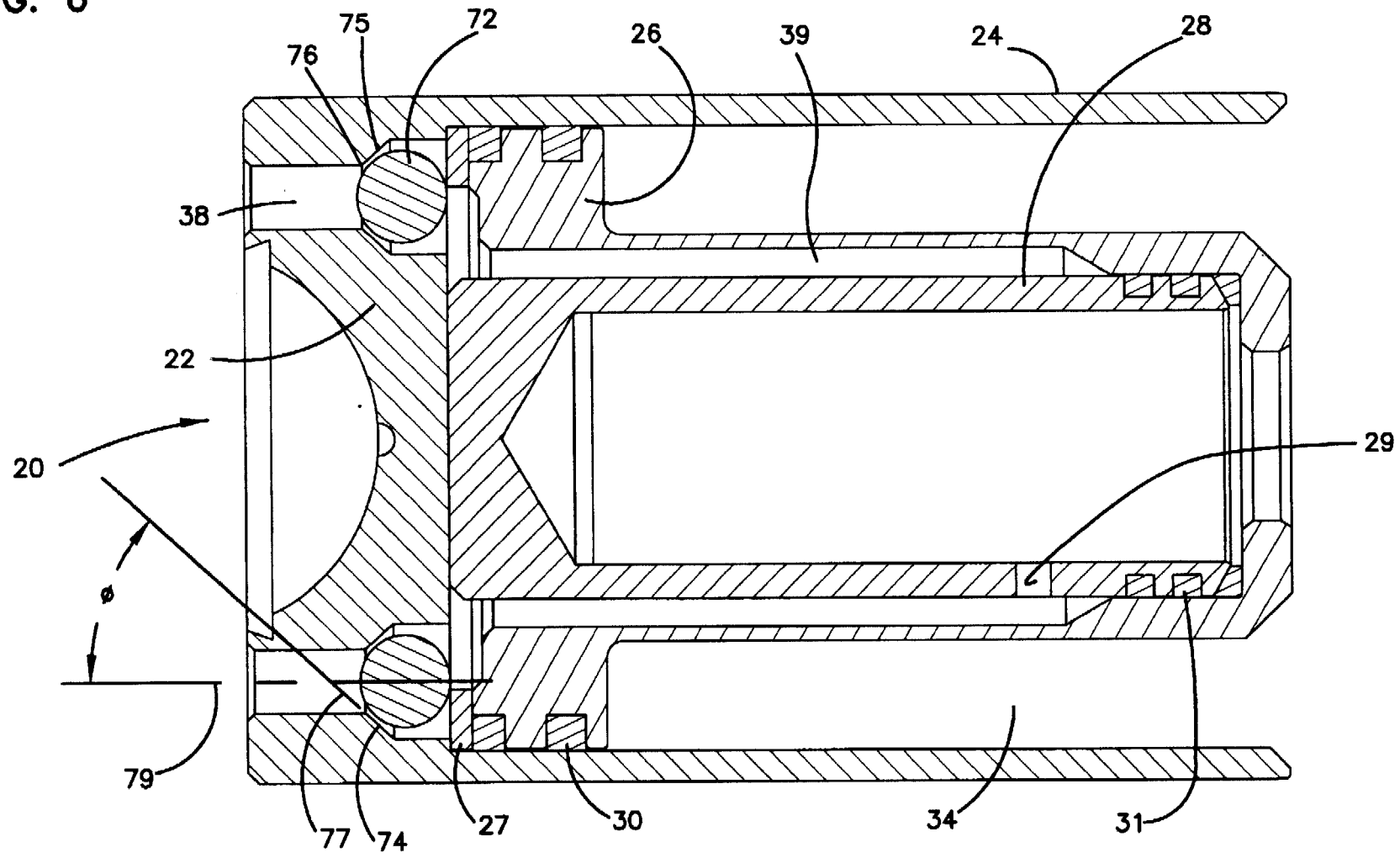
FIG. 6 is a cross sectional view of the piston assembly shown in FIG. 5 with the ball valves shown in the open position.

While the shorter ball lift in the reload check valve reduces the ball valve closure time and ball closure velocity with the significant benefits described above, the flow of hydraulic fluid through the reload check valve 70 is noticeably reduced due to this smaller ball lift 73 as shown in FIG. 5. Adequate hydraulic fluid flow through the hydraulic fluid inlet 36 is necessary to ensure complete reload of the piston chamber 34 on each reciprocation of the piston 20. Hydraulic fluid flow during reload is particularly important under pressure feed conditions given the relatively short time period for reload. To meet this flow demand, the reload check valve 70 of the present invention includes a plurality of hydraulic fluid inlets 36 and a corresponding plurality of ball valves 71 having a reduced ball lift 73 disposed within the inlets 36. As shown in FIGS. 5, 6, the upper inlets 38 and ball valves 71 are positioned within the end portion 22 of the piston 20 so that each ball valve is adjacent the hollow sleeve or lower section 39 of the hydraulic fluid inlet 36. With this arrangement, the ball valves 71 experience short closure time and low ball closure velocities and yet the flow of hydraulic fluid through the plurality of inlets 36 is sufficient for complete reload of the piston chamber 34 during the reload period under pressure feed conditions.

Figure 7:
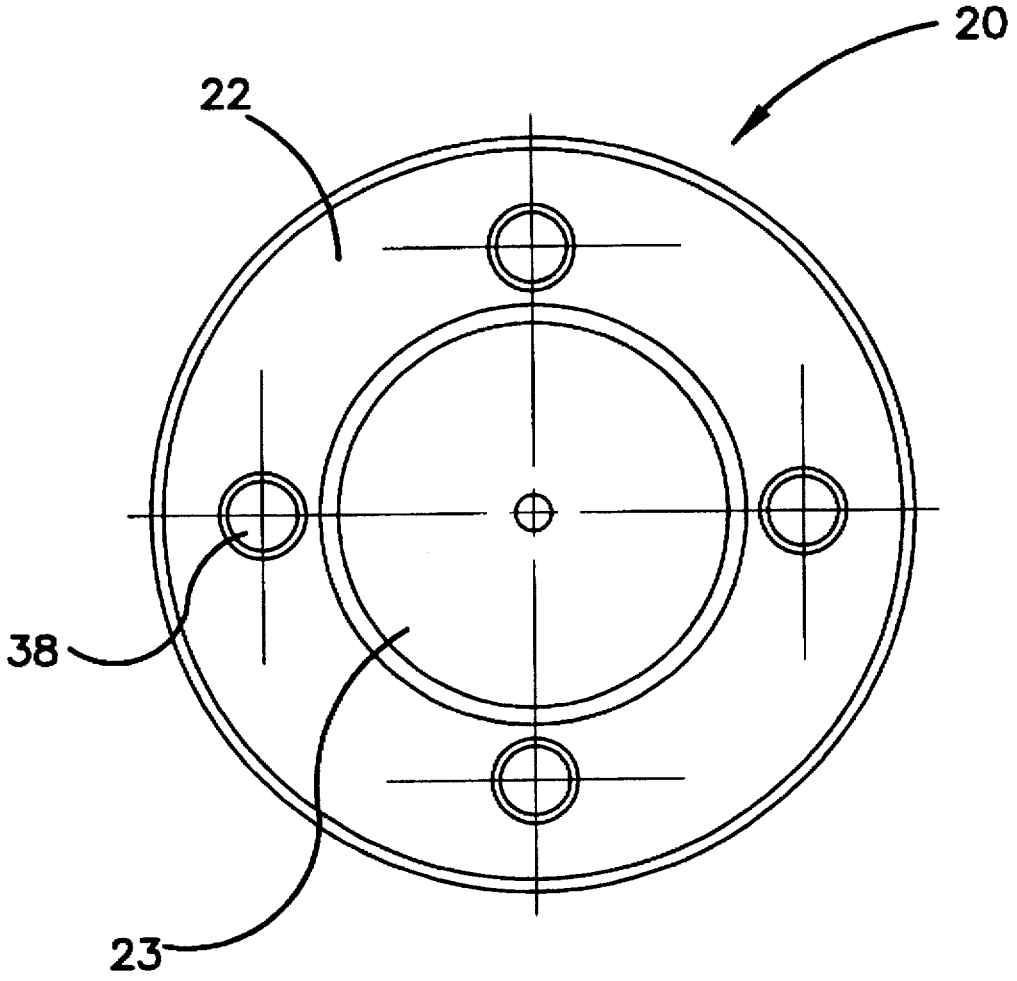
FIG. 7 is a top view of the piston assembly shown in FIG. 5 showing the location of the ball valves.

In a preferred embodiment, four inlets are disposed about the end section 22 of the piston 20 with four ball valves 71 having a reduced ball lift 73 (see FIG. 7). In this preferred embodiment, the ball lift 73 is designed to be less than or equal to 0.08 of the ball diameter. It is appreciated that a variety of other multiple inlet-ball valve combinations may be utilized in accordance with the principles of the present invention. The ball lift 73 may be varied so long as the ball valve 71 maintains minimal closure time to control the pressure rings associated with pressure build up and low closure velocity of the ball which is not high enough to damage the valve seat or ball. The number of inlets may be varied as well based on the chosen ball lift 73 to ensure adequate hydraulic fluid flow for complete reload of the piston chamber 34 under pressure feed conditions. It is also appreciated that an appropriate ball lift is variable depending on the operating conditions of the pump such as the viscosity of the hydraulic fluid. A more viscous hydraulic fluid will close the ball valve more quickly and is thus more tolerant of a larger ball lift 73.

Figure 5A:
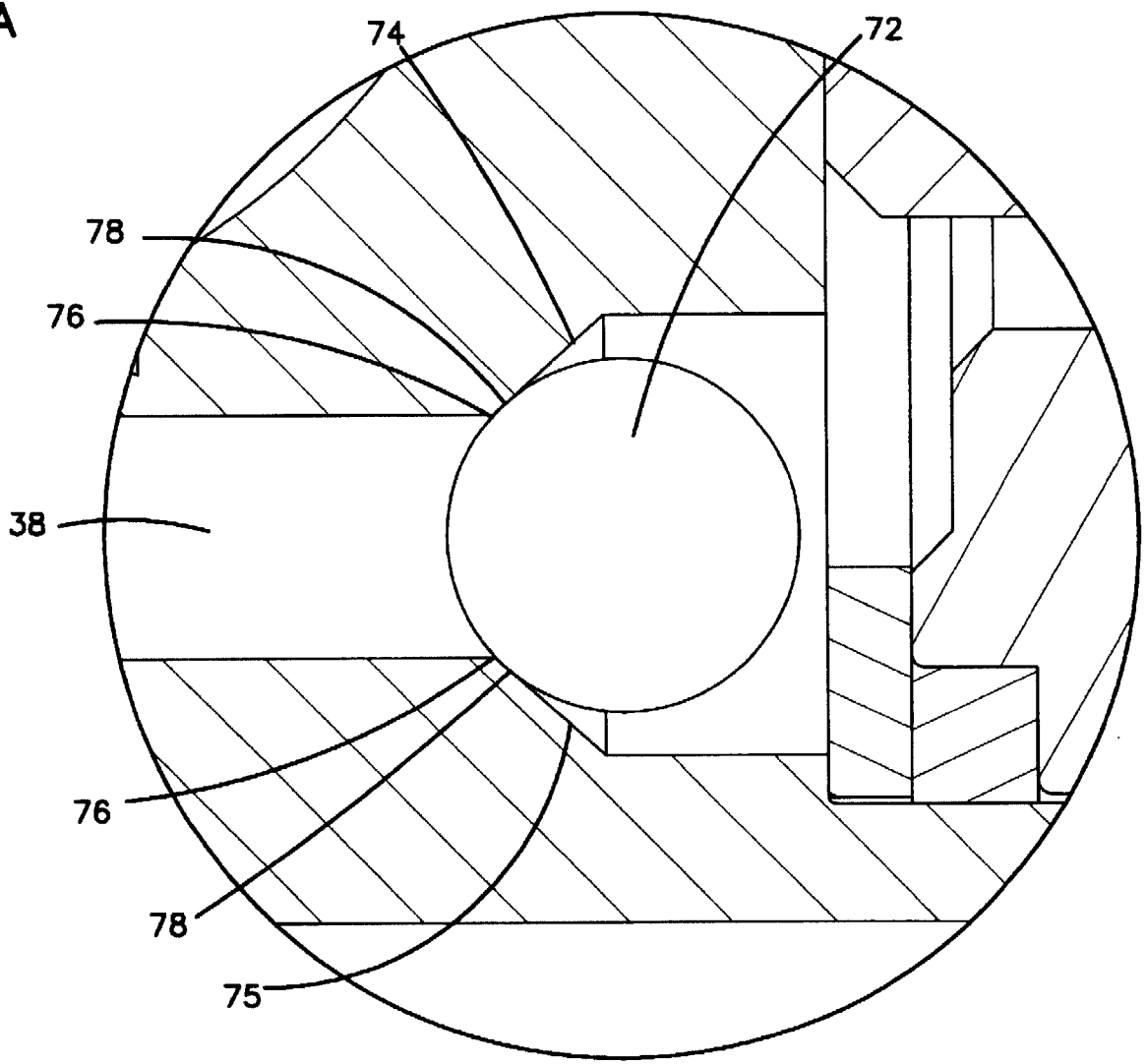
FIG. 5A is an enlarged cross sectional view of the ball and valve seat shown in FIG. 5.
Figure 9:
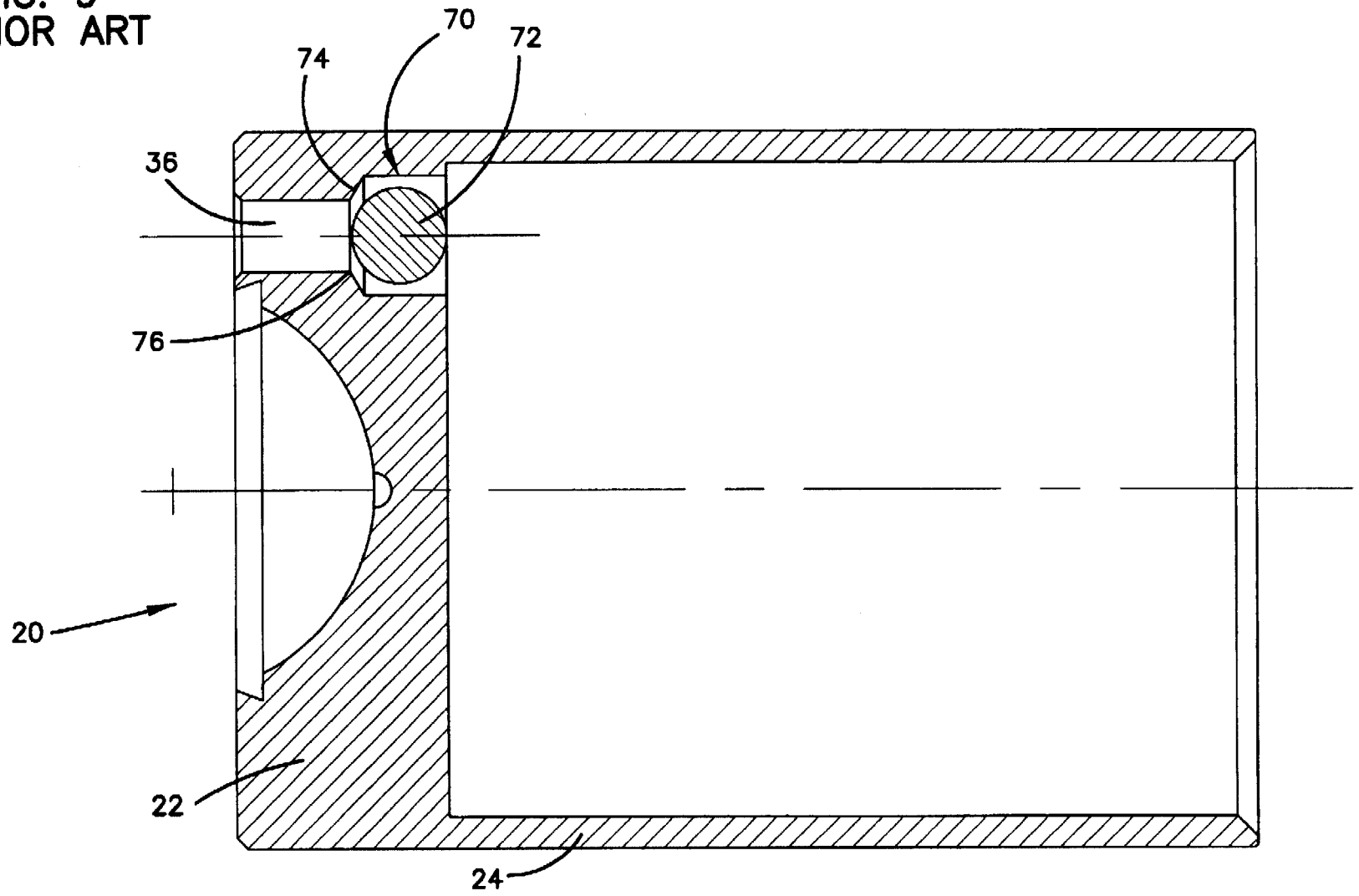
FIG. 9 PRIOR ART
FIG. 9 is a cross sectional view of the partial piston assembly shown in FIG. 8 showing the ball valve in the open position.

In accordance with another aspect of a preferred embodiment, the ball valves 71 include an improved valve seat configuration. Referring to FIGS. 5, 5A and 6, the valve seat 74 for the ball valve 71 is designed to eliminate damage due to ball impact against the valve seat 74. The ball seat 74 includes a conical section 75 which is sloped inward toward the upper section 38 of the hydraulic fluid inlet 36 and terminates at an inner edge 76 (see FIG. 6). This sloped conical section 75 helps direct the ball 72 toward the central axis 79 of the valve seat 74 to facilitate efficient closure of the ball valve 71. As shown in FIGS. 5-6, the slope (or angle) 77 of the conical section 75 is designed so that the tangential contact point 78 between the ball 72 and valve seat 74 is located at a position on the conical section 75 outward from the inner edge 76 of the valve seat 74 (see FIG. 5). In this way, as a ball 72 is slammed against the valve seat 74 as the piston 20 begins its power stroke, the ball 72 does not impact the inner edge 76 of the valve seat 74 (see FIG. 5A), which is prone to chipping upon repeated impacts. This minimizes the potential damage to the valve seat or ball and significantly improves the long-term performance of the diaphragm pump under pressure feed conditions as compared to prior diaphragm pumps with a valve seat configuration in which the ball impacts the inner edge of the valve seat (see FIGS. 8–9).

It should be noted that the slope angle 77 (FIG. 6) may be varied within a certain range in accordance with the principles of the present invention. The slope angle 77 must provide for tangential contact of the ball 72 against the conical section 75 at a sufficient distance away from the inner edge 76 to prevent chipping. However, the slope angle 77 must not be too steep or this will result in significantly reduced flow through the ball valve 71 and may effect the ability to provide sufficient hydraulic fluid flow for complete reload of the piston chamber under pressure feed conditions.

In one embodiment, the slope angle 77 is chosen to provide a tangential contact point at least 0.015 inches from the inner edge 76 of the valve seat 74. In a preferred embodiment, the slope angle 77 is chosen to provide a tangential contact point at approximately 0.020 inches from the inner edge 76 of the valve seat 74 (see FIG. 5A). This dimension is chosen to force the tangential contact point far enough way from the inner edge 76 of the valve seat 74 to insure no contact with the inner edge 76. When the ball 72 contacts the valve seat 74, there is a certain amount of elastic deformation between the ball 72 and the valve seat 74 to form an area of contact surrounding the circular tangential contact point. This area or zone of contact is estimated to be approximately 0.005 to 0.010 inches wide. Therefore, by designing the slope 77 of the valve seat 74 to direct the tangential contact point to at least 0.015 inches from the inner edge 74 of the valve seat 74, this insures that the 0.005 to 0.010 inch area or zone of contact between the ball 72 and valve seat 74 never propagates over to the inner edge 76 of the valve seat 74. This eliminates the possibility of valve seat chipping due to ball impact.

Figure 10:
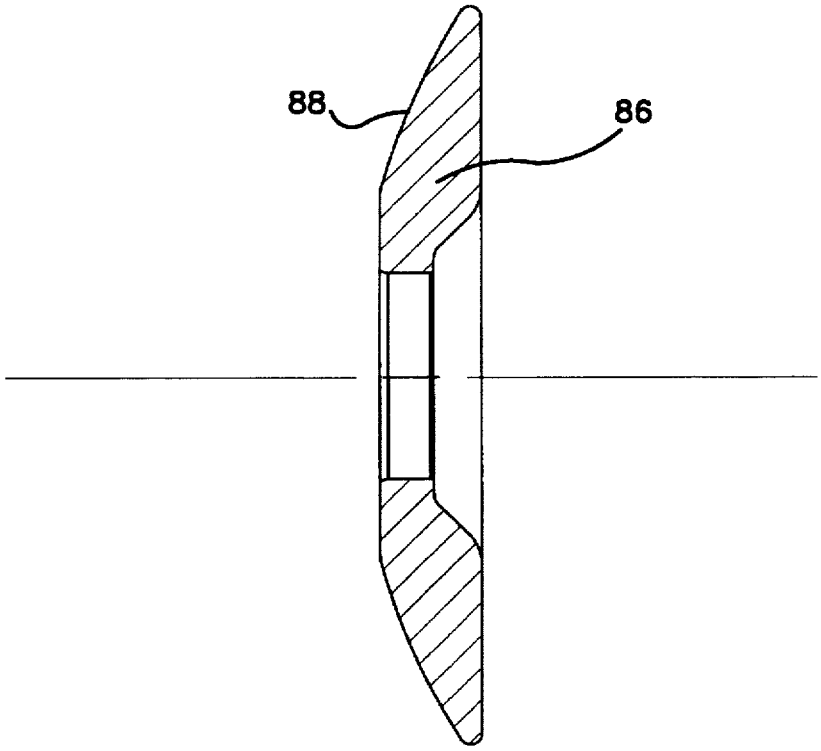
FIG. 10 is a cross sectional view of a diaphragm plunger according to the principles of the present invention.

In accordance with another preferred aspect of the present invention, a preferred diaphragm plunger 86 is provided as illustrated in FIG. 10. As discussed above, the diaphragm plunger 86 contacts the diaphragm stop 100 on the return stroke of the piston 20 under pressure feed conditions. The diaphragm plunger 86 includes a spherical impact surface 88 which is designed to impact the corresponding lower surface 102 of the diaphragm stop 100 at a position outward from the inner edge 104 of the diaphragm stop 100 and inward from the outer edge 89 of the plunger 86 (see FIG. 12). These edges 89, 104 are prone to chipping upon repeated impact under pressure feed conditions.

Figure 11:
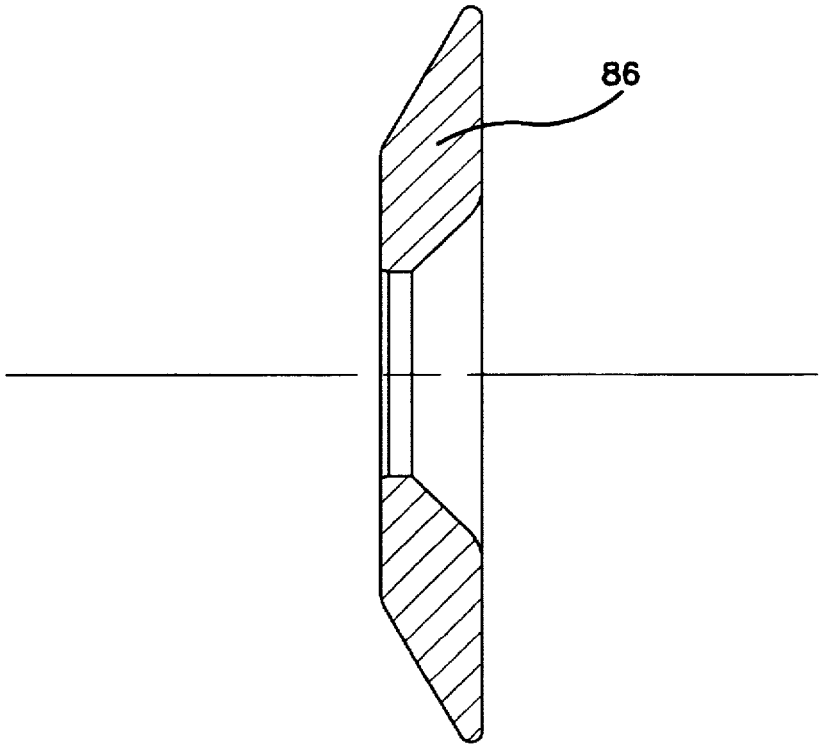
FIG. 11 PRIOR ART
FIG. 11 is a cross sectional view of a diaphragm plunger of a prior diaphragm pump.
Figure 13:
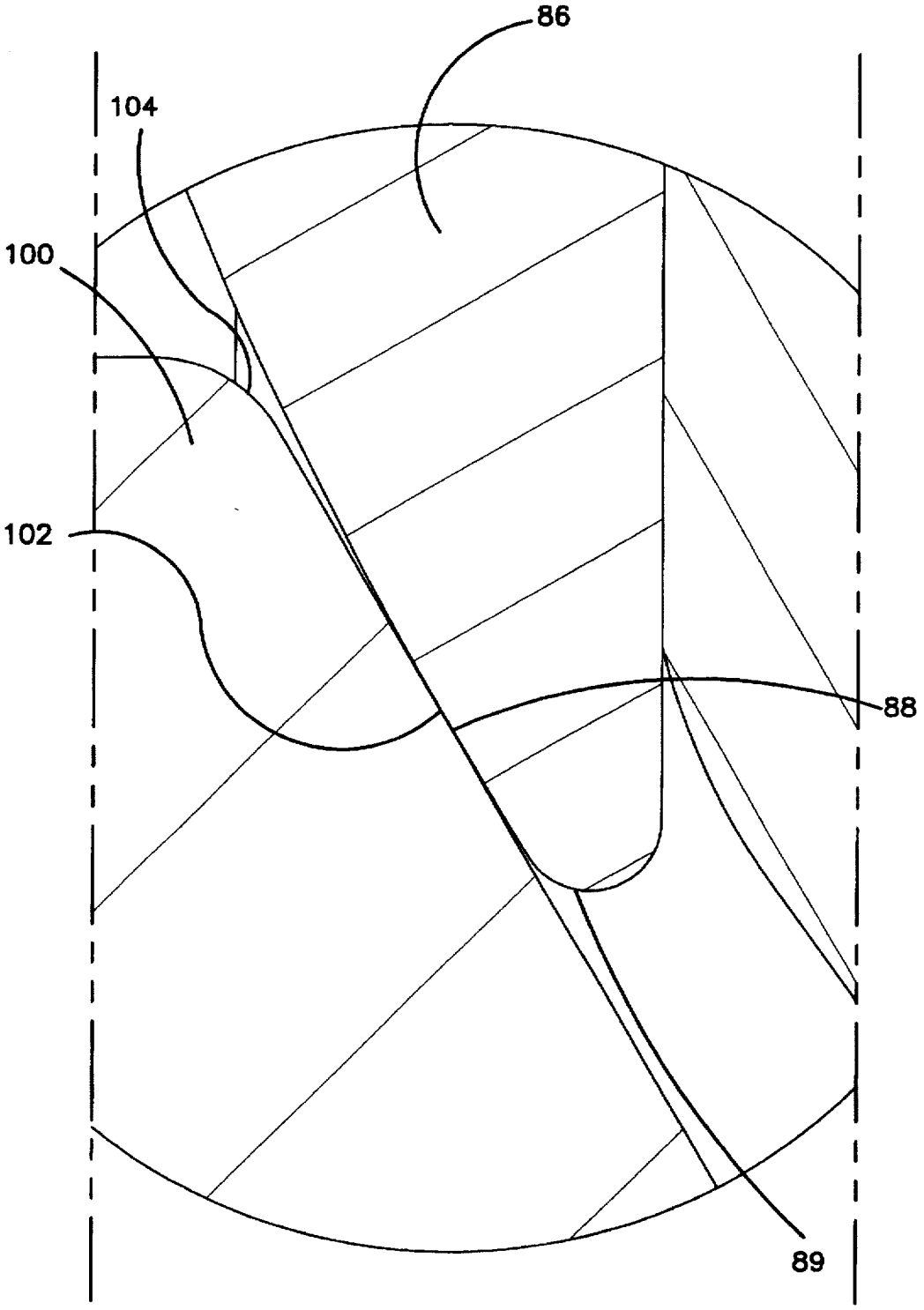
FIG. 13 is an enlarged cross sectional view of a portion of the diaphragm plunger and diaphragm stop of FIG. 12.

As shown in FIG. 13, the spherical impact surface 88 of the diaphragm plunger 86 contacts the lower surface 102 of the diaphragm stop 100 at a position away from the inner edge 104 the diaphragm stop 100 and the outer edge 89 of the plunger 86. In this way, the spherical surface 88 distributes impact forces along a portion of the diaphragm stop 100 so that the impact forces are not localized at a single point on the diaphragm stop 100. It is appreciated that such a design of the plunger impact surface 88 prevents the diaphragm plunger 86 from contacting the inner edge 104 of the diaphragm stop 100 or the outer edge 89 of the plunger 86 which greatly reduces the possibility of chipping of the fragile edges 104, 89 of the diaphragm stop 100 and plunger 86 as compared to prior diaphragm pumps in which the impact surface of the diaphragm plunger is a linear surface permitting impact at the inner edge of the diaphragm stop or outer edge 89 of the plunger 86 (see FIG. 11).

It is further appreciated that this spherical impact surface 88 is also more tolerant of variances in manufacturing tolerances of the stop 100 and plunger 86 or off-center plunger impacts as the spherical surface 88 assures contact between the plunger 86 and diaphragm stop 100 away from the edges of the stop 100 and plunger 86 even if the angle of the plunger impact varies (see FIG. 13). In a preferred embodiment, the radius of the spherical surface 88 is chosen so that the plunger 86 impacts the diaphragm stop 100 at the midway point between the inner edge 104 of the stop 100 and the outer edge 89 of the plunger 86. (See FIGS. 12, 13). This provides the maximum tolerance of error in both directions from the edges of the plunger 86 and stop 100 in the case of off-center plunger impact or manufacturing variances from designed plunger 86 and stop 100 dimensions. This minimizes the possibility of contact at either edge of the plunger 86 or stop 100 under pressure feed conditions to significantly reduce the possibility of chipping at these extreme edges 89, 104.

Figure 21:
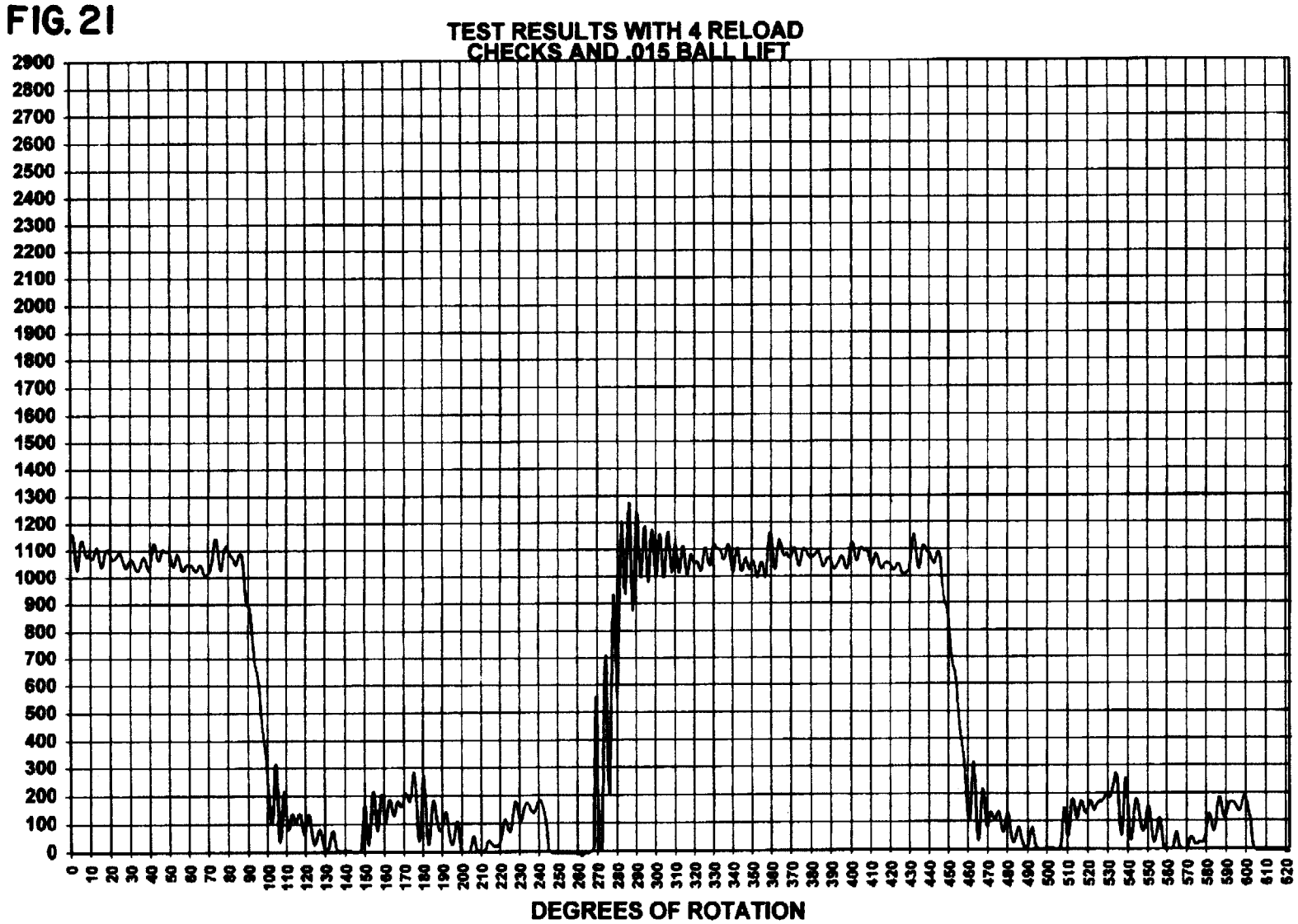
FIG. 21 is a graph of the pressure in the piston chamber of a diaphragm pump modified with four piston inlets and reduced ball lift in the ball valves as a function of the rotation of the input shaft of the wobble plate through several piston cycles under pressure feed conditions.
Figure 22:
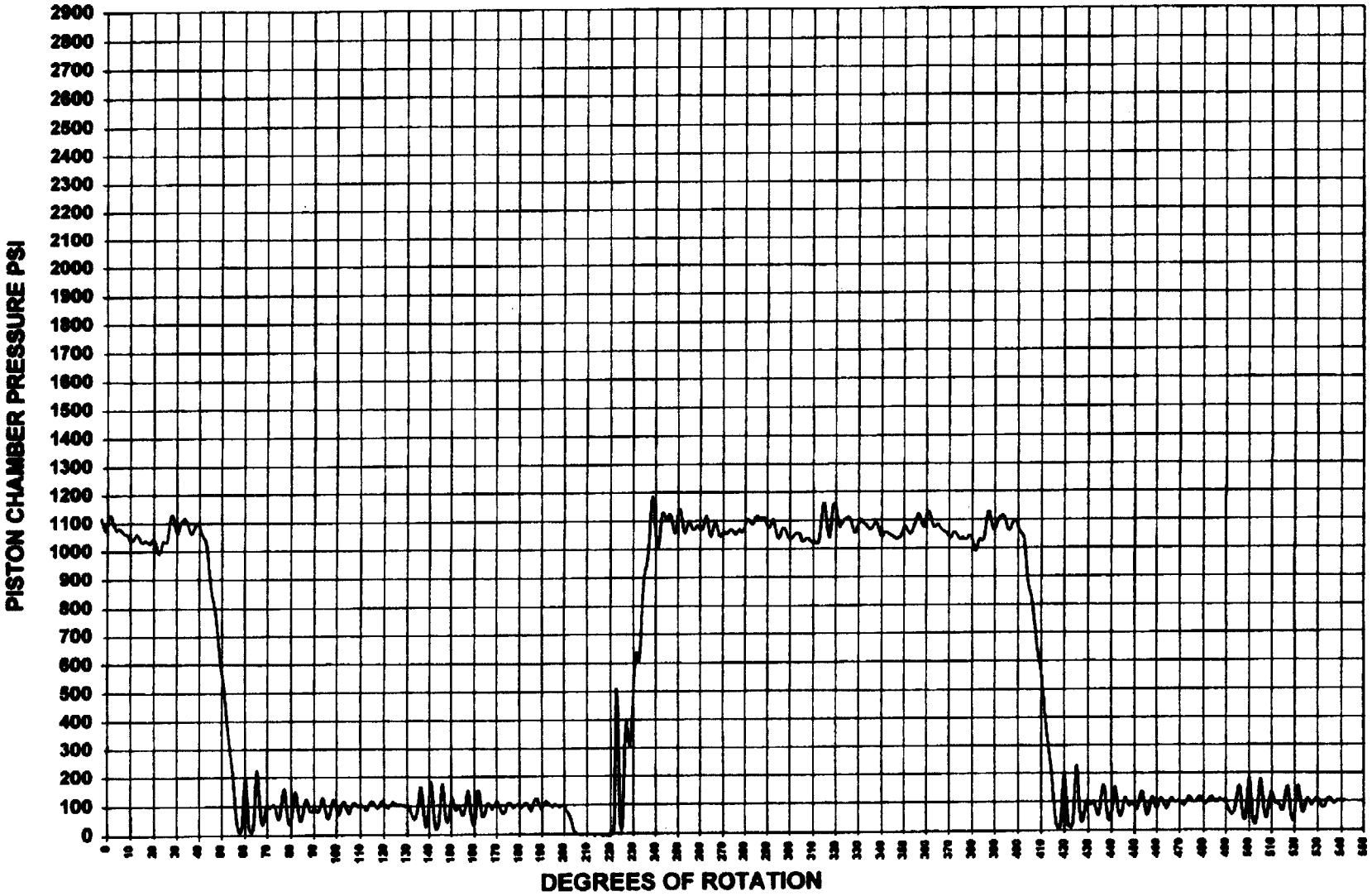
FIG. 22 is a graph of the pressure in the piston chamber of a diaphragm pump modified to include all the preferred embodiments of the present invention as a function of the rotation of the input shaft of the wobble plate through several piston cycles under pressure feed conditions.

Pursuant to additional aspects of a preferred embodiment, the graphs in FIGS. 20–22 illustrate the pressure in the piston chamber over the course of several piston cycles for various diaphragm pumps. FIG. 20 is for a prior art diaphragm pump described in the background of the invention and FIG. 21 is for a pump modified to have four inlets into the piston chamber and a reduced ball lift in each ball valve as described above. In comparing these two graphs, it is noted that the modified pump has significantly reduced pressure peaks during the start of the power stroke as compared to the prior diaphragm pump. However, the pressure rings are still noticeably present and the pressure fluctuates throughout the entire piston cycle (see FIG. 21). To further reduce the pressure rings and pressure fluctuations, it is necessary to make additional modifications to the pump which will be described below to obtain the more consistent and moderate pressures illustrated in the graph in FIG. 22.

According to one aspect of a preferred embodiment, the diaphragm pump 10 preferably includes an hydraulic fluid isolation reservoir 64 to reduce the possibility of air entrapment within the piston chamber 34 during pump operation. Referring to FIG. 16, the hydraulic fluid isolation reservoir 64 is disposed adjacent to and at a position above the wobble plate chamber 58. A hydraulic fluid fill tube 60 is provided which extends through the hydraulic fluid isolation reservoir 64 into the wobble plate chamber 58 to permit filling of the pump with hydraulic fluid as needed.

The hydraulic fluid isolation reservoir 64 is connected to the wobble plate chamber 58 through at least one passageway 62. In a preferred embodiment, the passageway 62 extends around the hydraulic fill tube 60 so that hydraulic fluid can freely flow between the wobble plate chamber 58 and hydraulic fluid isolation reservoir 64 (see FIG. 16). In this way, the diaphragm pump 10 is filled with hydraulic fluid prior to use such that the entire wobble plate chamber 58 is filled with hydraulic fluid and hydraulic fluid further flows into a portion of the hydraulic fluid isolation reservoir 60 to form an upper surface 66 of hydraulic fluid within the hydraulic fluid isolation reservoir 64. This upper surface 66 of hydraulic fluid is adjacent a certain amount of free air within the hydraulic fluid isolation reservoir 64. During operation, the motion of the wobble plate mechanism 50 within the wobble plate chamber 58 does not serve to mix the hydraulic fluid with any air since no free air exists in the wobble plate chamber 58. Rather, hydraulic fluid in the hydraulic fluid isolation reservoir 64 which is adjacent a certain amount of free air is not disturbed by the motion of the wobble plate mechanism and thus the hydraulic fluid does not intermix with the free air to form a compressible mixture. It should also be noted the passageway 62 allows the hydraulic fluid in the wobble plate chamber 58 to expand as it heats up during pump operation and flow into the isolation reservoir 64 without overflowing out the fill tube 60.

Figure 17:
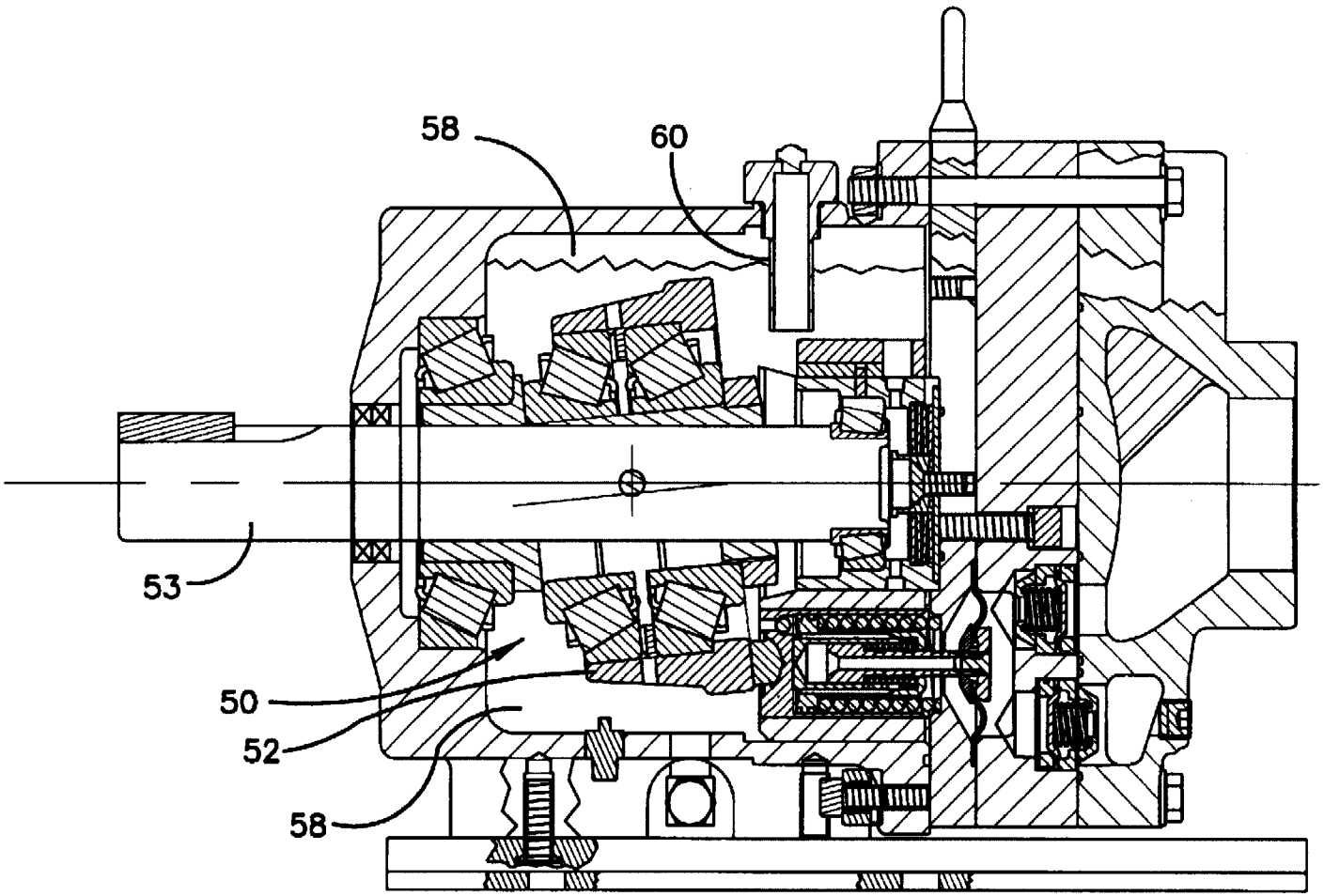
FIG. 17 PRIOR ART
FIG. 17 is a cross sectional view of a prior diaphragm pump.

This isolation reservoir 64 greatly reduces the possibility of air entrapment in the piston chamber 34 as compared to prior diaphragm pumps without the isolation reservoir as shown in FIG. 17. The hydraulic fluid isolation reservoir 64 of the present invention leads to improved pump performance and reduces the possibility and severity of any pressure peaks or rings within the piston chamber 34 during the initial build up of pressure in the piston chamber during the power stroke of the piston (See FIG. 22). It is noted that during operation, the diaphragm pump 10 needs to maintain a minimum level of hydraulic fluid within the hydraulic fluid isolation reservoir 64 to ensure that no free air is able to enter the wobble plate chamber 58. Filling of hydraulic fluid through the fill tube 60 accomplishes this in view of the passageway 62 connecting the hydraulic fluid isolation reservoir 64 and the wobble plate chamber 58. It is appreciated that one may vary the location and connection of the hydraulic fluid isolation reservoir 64 with respect to the wobble plate chamber 58 while still maintaining a complete fill of hydraulic fluid within the wobble plate chamber 58 in accordance with the principles of the present invention.

Figure 14:
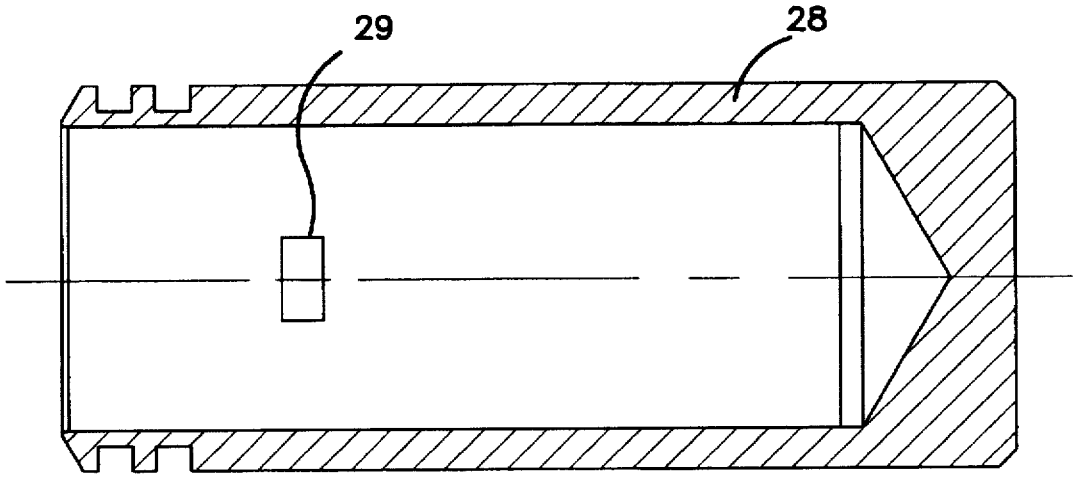
FIG. 14 is a cross sectional view of a cylinder valve housing according to the principles of the present invention.

Pursuant to another aspect of a preferred embodiment, the sliding valve assembly 106 includes a preferred opening 26 in the cylinder valve housing 28. As shown in FIG. 14, the cylinder valve housing 28 includes an elongated slot opening 29 which connects the hydraulic fluid inlet 36 with the piston chamber 34. As described above, the time period for hydraulic fluid reload under pressure feed conditions is relatively short and the elongated slot opening 29 in the cylinder valve housing 28 facilitates efficient flow of hydraulic fluid from the hydraulic fluid inlet 36 into the piston chamber 34. In a preferred embodiment, three slots 29 are disposed symmetrically about the cylinder valve housing 28 for enhanced flow.

Figure 15:
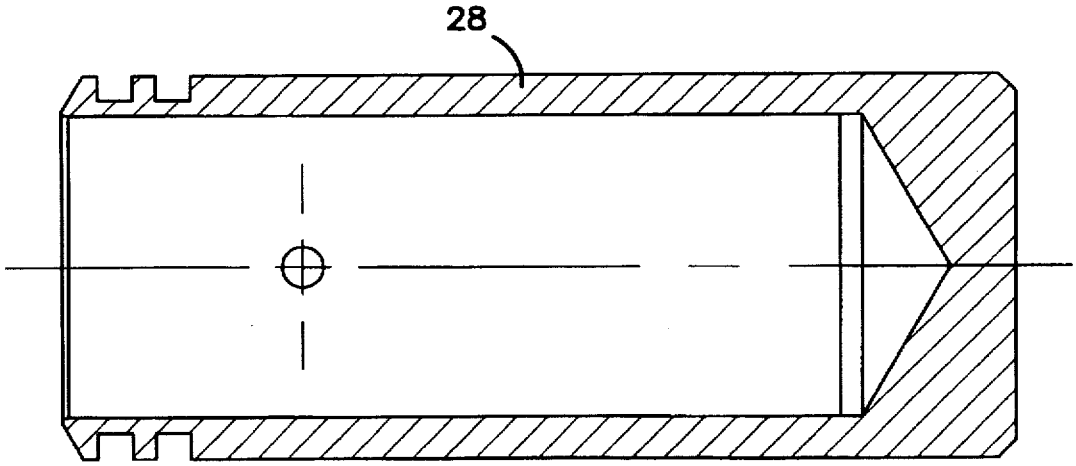
FIG. 15 PRIOR ART
FIG. 15 is a cross sectional view of a cylinder valve housing of a prior diaphragm pump.

As noted above, the sliding valve assembly 106 is generally open during the entire refill period under pressure feed conditions (see FIGS. 1, 2). The elongated slot opening 29 provides for quicker reload of hydraulic fluid as compared to the circular port in the sliding valve assembly of prior diaphragm pumps as shown in FIG. 15. This improved slot opening 29 reduces the likelihood of partial reload under pressure feed conditions and improves the overall reliability and performance of the diaphragm pump. It is appreciated that a variety of elongated shapes may be utilized for the slot opening including a rectangular or oval shape while still providing a suitable opening in accordance with the principles of the present invention.

It is noted that the combination of these preferred embodiments of the diaphragm pump described above results in a vastly improved diaphragm pump for use under pressure feed conditions. Referring to line A in the graph in FIG. 18, a diaphragm pump of the present invention shows drastically reduced pressure peaks or rings within the piston chamber during the power stroke with the pressure build up beginning substantially in conjunction with the piston beginning the power stroke in contrast to a similar graph for a prior diaphragm pump (see line A in FIG. 19). This results in a diaphragm pump with more consistent flow and pressures in all phases of the pumping cycle and greater long-term performance under pressure feed conditions.

As illustrated in FIGS. 21–22, the combination of a diaphragm pump incorporating all modifications (FIG. 22) provides additional improvement in reducing the pressure peaks during the power stroke as compared to a pump modified with only additional piston inlets and reduced ball lift in the ball valves (FIG. 21). Pressure fluctuations are also reduced throughout the entire piston cycle when incorporating all modifications in a diaphragm pump of the present invention (FIGS. 21–22).

With respect to piston component deterioration due to plunger-stop impact and ball-valve seat impact, tests conducted with the present invention have demonstrated significant improvement in pump reliability and performance under extended use. Inspection of the piston components after use under pressure feed conditions indicates substantially no damage or chipping of the plunger or stop edges or the valve seat which significantly reduces the pump failure rate as compared to prior diaphragm pumps described above.

It is to be understood that even though numerous characteristics and advantages of various embodiments of the present invention have been set forth in the foregoing description, together with the details of the structure and function of various embodiments of the invention, this disclosure is illustrative only and changes may be made in the detail, especially in matters of shape, size, and arrangement of parts within the principles of the present invention, to the full extent indicated by the broad general meaning of the terms in which the appended claims are expressed.

Other modifications of the invention will be apparent to those skilled in the art in view of the foregoing descriptions. These descriptions are intended to provide specific examples of embodiments which clearly disclose the prevent invention. Accordingly, the invention is not limited to the described embodiments or to use of specific elements, dimensions, materials or configurations contained therein. All alternative modifications and variations of the present invention which fall within the spirit and broad scope of the appended claims are covered.

What is claimed is:

1. A diaphragm pump having a piston adapted for reciprocal movement from a first to a second position defining a power stroke and from the second to the first position defining a return stroke, a diaphragm moveable between first and second positions, a pumping chamber on one side of the diaphragm, a piston chamber on the other side of the diaphragm having a volume defined, in part, by the relative positions of the piston and diaphragm, a source of hydraulic fluid connected with the piston chamber to allow hydraulic fluid into the piston chamber, the hydraulic fluid in the piston chamber serving to transfer motion of the piston to the diaphragm, and means for reciprocating the piston, said diaphragm pump comprising:

a plurality of piston inlets connecting the hydraulic fluid source with the piston chamber; and check valve means for permitting the flow of hydraulic fluid from the hydraulic fluid source to the piston chamber when the pressure in the piston chamber is less than the pressure in the hydraulic fluid source and for preventing the flow of hydraulic fluid when the pressure in the piston chamber is greater than the pressure in the hydraulic fluid source, said check valve means including a plurality of ball valves, each having a ball and valve seat, which are disposed within the plurality of inlets from the hydraulic fluid source to the piston chamber, said ball valves movable between a closed position and an open position such that the ball is disposed in contacting relationship against the valve seat when the ball valve is in the closed position, said valve seat including a conical section sloped inward toward the hydraulic fluid inlet and having an inner edge adjacent the inlet, wherein the slope of the conical section is such that the tangential contact point between the ball and valve seat when the ball valve is in the closed position is located at a position on the conical section outward from the inner edge of the valve seat, and wherein the distance the ball is permitted to move between the open and closed positions is such that the ball valve closes substantially in conjunction with the piston beginning its power stroke and the ball is not able to generate a high closure velocity when moving from the open to the closed position.

2. The diaphragm pump of claim 1 wherein the distance the check valve ball is permitted to move between the open and closed positions is less than or equal to 0.08 of the diameter of the ball.

3. The diaphragm pump of claim 1 wherein the slope of the conical section of the valve seat is such that the tangential contact point between the ball and valve seat when the ball valve is in the closed position is equal to or greater than 0.015 inches from the inner edge of the valve seat.

4. The diaphragm pump of claim 1 wherein the slope of the conical section of the valve seat is such that the tangential contact point between the ball and valve seat when the ball valve is in the closed position is equal to or greater than 0.020 inches from the inner edge of the valve seat.

5. The diaphragm pump of claim 1 wherein said check valve means includes four ball valves disposed within four inlets from the hydraulic fluid source to the piston chamber.

6. The diaphragm pump of claim 1 further comprising a diaphragm stop for limiting movement of the diaphragm away from the pumping chamber, said diaphragm stop having an inner edge; and a diaphragm plunger connected to the diaphragm which contacts the diaphragm stop during the return stroke of the piston under a pressure feed condition, said plunger having an outer edge and including a spherical surface portion wherein the spherical surface portion contacts the diaphragm stop at a position outward from the inner edge of the diaphragm stop and inward from the outer edge of the plunger when the plunger contacts the diaphragm stop.

7. The diaphragm pump of claim 6 wherein the spherical surface portion of the plunger contacts the diaphragm stop at a point midway between the inner edge of the diaphragm stop and the outer edge of the plunger.

8. The diaphragm pump of claim 1 further comprising a piston reciprocating chamber adjacent the piston such that the hydraulic fluid source is located within the piston reciprocating chamber; and an isolation reservoir adjacent and connected to said piston reciprocating chamber such that the hydraulic fluid completely fills the piston reciprocating chamber and further flows into the isolation reservoir to form an upper surface of hydraulic fluid within the isolation reservoir.

9. The diaphragm pump of claim 1 further comprising sliding valve means responsive to the relative movement between the diaphragm and piston for controlling the flow of hydraulic fluid from the hydraulic fluid source into the piston chamber, wherein the sliding valve means includes a cylinder valve connected to the diaphragm and a cylinder valve housing connected to the piston and adapted to receive the cylinder valve therein, said cylinder valve housing including at least one elongated slot disposed adjacent said cylinder valve to permit the flow of hydraulic fluid into the piston chamber.

10. A diaphragm pump having a piston adapted for reciprocal movement from a first to a second position defining a power stroke and from the second to the first position defining a return stroke, a diaphragm moveable between first and second positions, a pumping chamber on one side of the diaphragm, a piston chamber on the other side of the diaphragm having a volume defined, in part, by the relative positions of the piston and diaphragm, a source of hydraulic fluid connected with the piston chamber to allow hydraulic fluid into the piston chamber, the hydraulic fluid in the piston chamber serving to transfer motion of the piston to the diaphragm, and means for reciprocating the piston, said diaphragm pump comprising:

a plurality of piston inlets connecting the hydraulic fluid source with the piston chamber;

check valve means for permitting the flow of hydraulic fluid from the hydraulic fluid source to the piston chamber when the pressure in the piston chamber is less than the pressure in the hydraulic fluid source and for preventing the flow of hydraulic fluid when the pressure in the piston chamber is greater than the pressure in the hydraulic fluid source, said check valve means including a plurality of ball valves, each having a ball and valve seat, which are disposed within the plurality of inlets connecting the hydraulic fluid source with the piston chamber, said ball valves movable between a closed position and an open position such that the ball is disposed in contacting relationship against the valve seat when the ball valve is in the closed position, said valve seat including a conical section sloped inward toward the hydraulic fluid inlet and having an inner edge adjacent the inlet, wherein the slope of the conical section is such that the tangential contact point between the ball and valve seat when the ball valve is in the closed position is located at a position on the conical section outward from the inner edge of the valve seat, and wherein the distance the ball is permitted to move between the open and closed positions is such that the ball valve closes substantially in conjunction with the piston beginning its power stroke and the ball is not able to generate a high closure velocity when moving from the open to the closed position;

a diaphragm stop for limiting movement of the diaphragm away from the pumping chamber, said diaphragm stop having an inner edge;

a diaphragm plunger connected to the diaphragm which contacts the diaphragm stop during the return stroke of the piston under a pressure feed condition, said plunger having an outer edge and including a spherical surface portion wherein the spherical surface portion contacts the diaphragm stop at a position outward from the inner edge of the diaphragm stop and inward from the outer edge of the plunger when the plunger contacts the diaphragm stop;

a piston reciprocating chamber adjacent the piston such that the hydraulic fluid source is located within the piston reciprocating chamber;

an isolation reservoir adjacent and connected to said piston reciprocating chamber such that hydraulic fluid completely fills the piston reciprocating chamber and further flows into the isolation reservoir to form an upper surface of hydraulic fluid within the isolation reservoir; and sliding valve means responsive to the relative movement between the diaphragm and piston for controlling the flow of hydraulic fluid from the hydraulic fluid source into the piston chamber, wherein the sliding valve means includes a cylinder valve connected to the diaphragm and a cylinder valve housing connected to the piston and adapted to receive the cylinder valve therein, said cylinder valve housing including at least one elongated slot disposed adjacent said cylinder valve to permit the flow of hydraulic fluid into the piston chamber.

11. The diaphragm pump of claim 10 wherein the distance the check valve ball is permitted to move between the open and closed positions is less than or equal to 0.08 of the diameter of the ball and the slope of the conical section of the valve seat is such that the tangential contact point between the ball and valve seat when the ball valve is in the closed position is equal to or greater than 0.015 inches from the inner edge of the valve seat.

12. The diaphragm pump of claim 10 wherein the spherical surface portion of the plunger contacts the diaphragm stop at a point midway between the inner edge of the diaphragm stop and the outer edge of the plunger.

* * * * *